US008430597B2

(12) United States Patent
Shipley et al.

(10) Patent No.: US 8,430,597 B2
(45) Date of Patent: Apr. 30, 2013

(54) RECONFIGURABLE OBSTACLE SYSTEM FOR A RIVER CHANNEL

(75) Inventors: Scott Richmond Shipley, Lyons, CO (US); Andrew Duncan Laird, Whitehaven (GB)

(73) Assignee: Rapidblocs Limited, Whitehaven (GB)

( * ) Notice: Subject to any disclaimer, the term of this patent is extended or adjusted under 35 U.S.C. 154(b) by 378 days.

(21) Appl. No.: 12/757,113

(22) Filed: Apr. 9, 2010

(65) Prior Publication Data

US 2010/0260548 A1 Oct. 14, 2010

Related U.S. Application Data

(60) Provisional application No. 61/168,098, filed on Apr. 9, 2009.

(51) Int. Cl.
*E02B 3/02* (2006.01)

(52) U.S. Cl.
USPC ..... 405/79; 405/110; 405/114; 472/13; 472/128

(58) Field of Classification Search ..... 405/79, 405/110, 111, 112, 114; 472/13, 128; 4/495, 4/501; 52/710
See application file for complete search history.

(56) References Cited

U.S. PATENT DOCUMENTS

| | | | | |
|---|---|---|---|---|
| 1,902,741 | A * | 3/1933 | Weber | 405/110 |
| 3,253,064 | A | 5/1966 | Buonaiuto | |
| 3,333,420 | A | 8/1967 | Henson | |
| 3,913,332 | A * | 10/1975 | Forsman | 405/79 |
| 4,372,705 | A | 2/1983 | Atkinson | |
| 4,397,578 | A | 8/1983 | Inman | |
| 4,474,504 | A | 10/1984 | Whitman et al. | |
| 4,708,554 | A * | 11/1987 | Howard | 411/84 |
| RE32,663 | E | 5/1988 | Atkinson | |
| 5,087,150 | A | 2/1992 | McCreary | |
| 5,219,315 | A * | 6/1993 | Fuller et al. | 472/59 |
| 5,421,782 | A | 6/1995 | Lochtefeld | |
| 5,443,326 | A | 8/1995 | Bernard et al. | |
| 5,855,481 | A | 1/1999 | Weichselbaum | |
| 6,454,659 | B1 | 9/2002 | Noble | |
| 6,475,095 | B1 | 11/2002 | Henry | |
| 6,743,108 | B2 | 6/2004 | Hunter | |
| 7,008,329 | B2 | 3/2006 | Hunter | |
| 7,229,359 | B2 | 6/2007 | Henry et al. | |
| 7,285,053 | B2 | 10/2007 | Henry et al. | |
| 2005/0090321 | A1 | 4/2005 | Henry et al. | |

(Continued)

FOREIGN PATENT DOCUMENTS

| | | |
|---|---|---|
| EP | 0569499 | 11/1993 |
| EP | 2069590 | 6/2009 |

(Continued)

*Primary Examiner* — David Bagnell
*Assistant Examiner* — Benjamin Fiorello
(74) *Attorney, Agent, or Firm* — James M. Weatherly; Cochran Freund & Young LLC

(57) ABSTRACT

Disclosed is a reconfigurable obstacle system for a river channel in a river park. Each obstacle assembly includes a plurality of obstacles. Obstacles may include a hollow structural box, a strut channel frame and a plurality of connectors that cooperate to divert water when installed in a river channel. A plurality of connectors pass through the hollow structural box when holding the obstacle in position. The obstacle assemblies can be reconfigured as desired, e.g. increase amplitude of a wave, speed up water flow, change depth, etc.

16 Claims, 29 Drawing Sheets

U.S. PATENT DOCUMENTS

| | | | | |
|---|---|---|---|---|
| 2005/0286976 | A1* | 12/2005 | Lochtefeld et al. | 405/79 |
| 2007/0049387 | A1 | 3/2007 | Henry et al. | |
| 2008/0101866 | A1 | 5/2008 | McLaughlin | |
| 2008/0101867 | A1 | 5/2008 | McLaughlin | |
| 2009/0280915 | A1 | 11/2009 | Shipley | |

FOREIGN PATENT DOCUMENTS

| | | |
|---|---|---|
| EP | 2122063 | 11/2009 |
| WO | 2008037928 | 4/2008 |
| WO | 2008084036 | 7/2008 |

* cited by examiner

RECONFIGURABLE OBSTACLE SYSTEM FOR A RIVER CHANNEL

CROSS-REFERENCE TO RELATED APPLICATION

This application claims the benefit of and priority to U.S. Provisional Patent Application Ser. No. 61/168,098, entitled "Reconfigurable Obstacle System for a River Channel," filed Apr. 9, 2009, the entire contents of which are specifically incorporated herein by reference for all that they disclose and teach.

BACKGROUND

There are many forms of water recreation. Common types include kayaking and canoeing in which a person often enjoys taking such water vessels down rapids. The natural environment supplies rapids which are geological formations in a riverbed wherein water flows from a higher elevation to a lower elevation. Many people go on white water rapid trips and also consider it to be a sport. As urban populations increase, the demand for nearby water sports increases.

SUMMARY

An embodiment of the present invention may therefore comprise method of configuring an obstacle assembly for water flowing in a river channel comprising: providing a plurality of strut channel rails disposed in the river channel; providing a first obstacle comprising: a first hollow structural box; a first strut channel frame comprising a slotted face and an oppositely disposed web separated by a first leg and a second leg, the first strut channel frame web adjoining the first hollow structural box; and a first connector spanning through the first hollow structural box and the first strut channel frame; attaching the first obstacle to the river channel with the first connector and the plurality of strut channel rails disposed in the river channel, thereby compressing the first hollow structural box; providing a second obstacle comprising: a second hollow structural box; a second strut channel frame comprising a slotted face and an oppositely disposed web separated by a first leg and a second leg, the first strut channel frame web adjoining the second hollow structural box; and a second connector spanning through the second hollow structural box and the second strut channel frame; attaching the second obstacle to the first obstacle with the second connector, thereby compressing the second hollow structural box and configuring the obstacle assembly for the water flowing in the river channel.

An embodiment of the present invention may further comprise a reconfigurable obstacle for diverting water flow in a river channel comprising: a hollow structural box comprising: a top and an oppositely disposed bottom offset from each other by: a left side and an oppositely disposed right side, a front side and an oppositely disposed back side; the hollow structural box defining an interior portion and an exterior portion separated by the top, the bottom, the left side, the right side, the front side, and the back side; a first plurality of openings formed through the hollow structural box top; a second plurality of openings formed through the hollow structural box bottom, the second plurality of openings aligned to the first plurality of openings; a strut channel frame comprising a slotted face and an oppositely disposed web separated by a first leg and a second leg, the strut channel frame web adjoining the hollow structural box top; a third plurality of openings formed in the strut channel frame web, the third plurality of openings aligned to the hollow structural box first plurality of openings; a first connector defining a first end and an oppositely disposed second end, the first connector comprising: a mount attached to the first connector first end; a fastener attached to the first connector second end; the first connector extending through both the hollow structural box bottom and the obstacle top thereby piercing through the hollow structural box interior portion; the first connector oriented so that: the first connector mount is both adjacent to the hollow structural box bottom and located in the hollow structural box exterior portion; and, the first connector fastener is both adjacent to the strut channel frame slotted face and located in the hollow structural box exterior portion; the first connector pierces at least one of the hollow structural box first plurality of openings, at least one of the hollow structural box second plurality of openings, and at least one of the strut channel frame third plurality of openings; and the first connector mount attached to the river channel thereby diverting water flow in the river channel.

An embodiment of the present invention may further comprise a method of making a reconfigurable obstacle comprising: forming a hollow structural box defining an interior portion and an exterior portion at a temperature greater than 130 degrees Fahrenheit; adjoining a strut channel frame before cooling the hollow structural box below 130 degrees Fahrenheit, the strut channel comprising openings formed therein; removing a portion of the hollow structural box aligned with the strut channel frame openings thereby creating openings; and installing a connector in the hollow structural box openings and the strut channel frame openings that pierces the hollow structural box interior.

An embodiment of the present invention may further comprise a method of configuring an obstacle assembly for water flowing in a river channel comprising: providing a first obstacle comprising: a first hollow structural box; and a first connector spanning through the first hollow structural box; attaching the first obstacle to the river channel with the first connector; providing a second obstacle comprising: a second hollow structural box; and a second connector spanning through the second hollow structural box; attaching the second obstacle to the first obstacle with the second connector thereby configuring the obstacle assembly for water flowing in the river channel.

DETAILED DESCRIPTION

Figure 1:
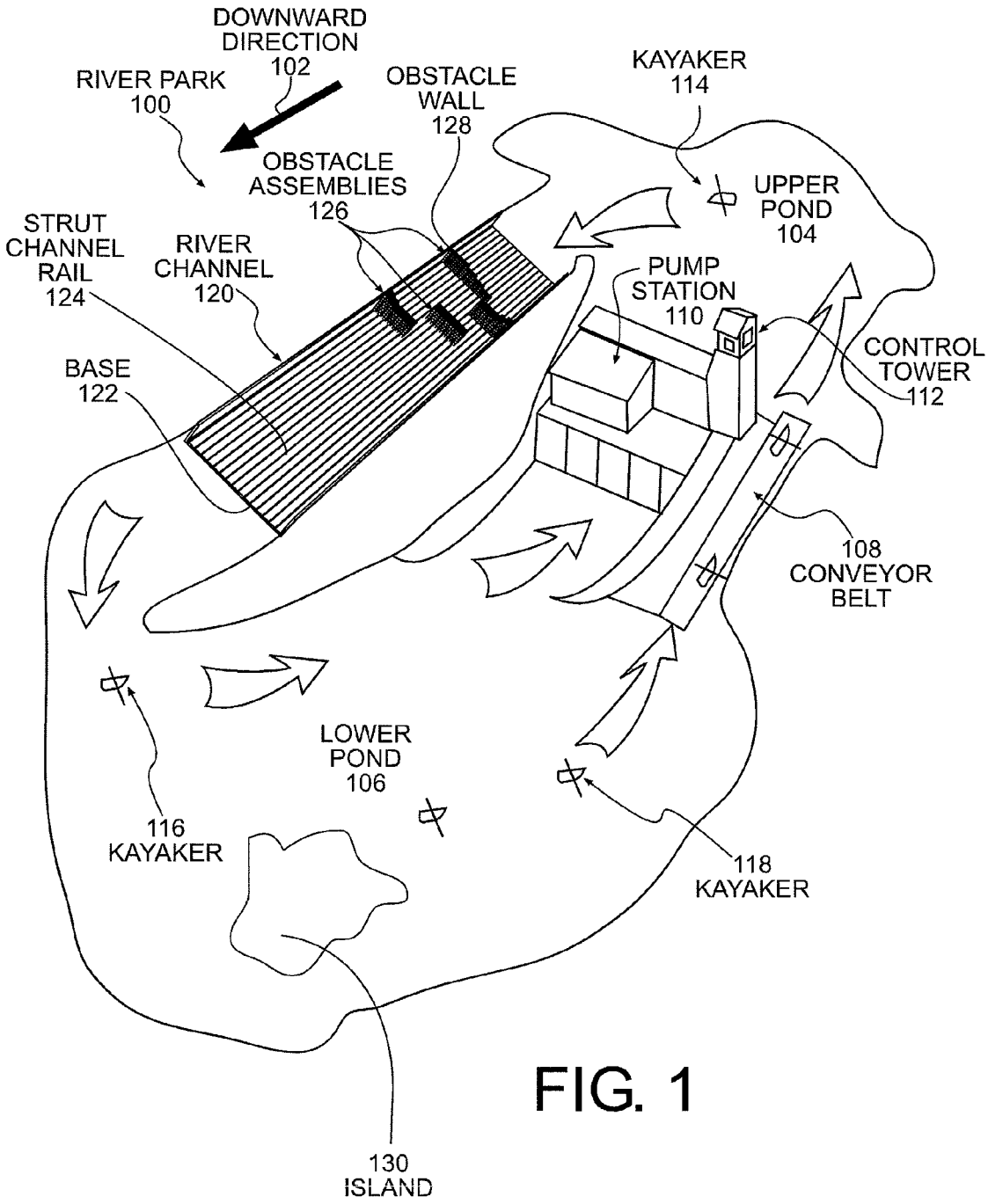
FIG. 1 is a perspective schematic view illustrating a river park employing an embodiment of the invention.

FIG. 1 is a perspective view of one embodiment of an artificial river park 100 for water recreation that is built on a hill having a downward direction 102. Artificial river park 100 is a man made recreational park that can be utilized in many different locations so that people who do not live close to or are not able to utilize natural water formations are able practice water sports. Water sports comprise and are not limited to river boarders, canoers, bodysurfers, surfboarders, boogie boarders, tubers, rafters, and any other water sports. River park 100 simulates a natural river wherein people are can have fun, compete in water sports, and also provide a location for rescue divers to perform, or train for rescue operations.

River park 100 is built on a hill allowing the force of gravity to create water flow in a general downward direction 102. In other words, water flows from upper pond 104, down river channel 120 and into lower pond 106. While water travels down the river channel 120, water is obstructed by the obstacle assemblies 126 which causes the water to speed up, change direction and generally provides a challenging environment for kayaking and other water sports. After the water exits the river channel 120 to the lower pond 106, the water is mechanically pumped to the upper pond 104 via the pump station 110. Alternatively, water flows from a source such as a stream or lake and flows out of the lower pond 106 into the stream at a lower elevation or another lake. River park users such as individual kayakers 114-118, travel from the upper pond 104 down the river channel 120 to the lower pond 106. River channel 120 is provided with the obstacle assemblies 126 that disrupt the flow of water in the river channel 120, thereby making passage down the river channel 120 challenging. Obstacle assemblies 126 are reconfigurable. In other words, obstacle assemblies 126 can be refigured to allow varying types of rapids down river channel 120. For example, the obstacle assemblies 126 illustrated in FIG. 1 are configured to allow water to shift from side to side that mimic geological formations in a natural riverbed. The obstacle assemblies 126 are attached to a base 122 of the river channel 120, wherein strut channel rails 124 are embedded in the river channel base 122. Obstacle assemblies 126 include at least one obstacle wall 128 that is assembled and attached to the river channel 120.

Once the kayaker 118 or other water park user travels through the river channel 120 and desires to return to the upper pond 104, elevation can be gained via the conveyor belt 108 or similar device that transports kayakers 114-118 or other water park users from the lower pond 106 to the upper pond 104. The activities in the river park 100 can be monitored by personnel located in the control tower 112 to provide a safe and enjoyable experience. It should be noted that other water park users may include river boarders, canoers, bodysurfers, surfboarders, boogie boarders, tubers, rafters, and any other water sport people that engage in water sports, which are generically referred to herein as kayakers. FIG. 1 also illustrates island 130 that is optional.

Figure 2:
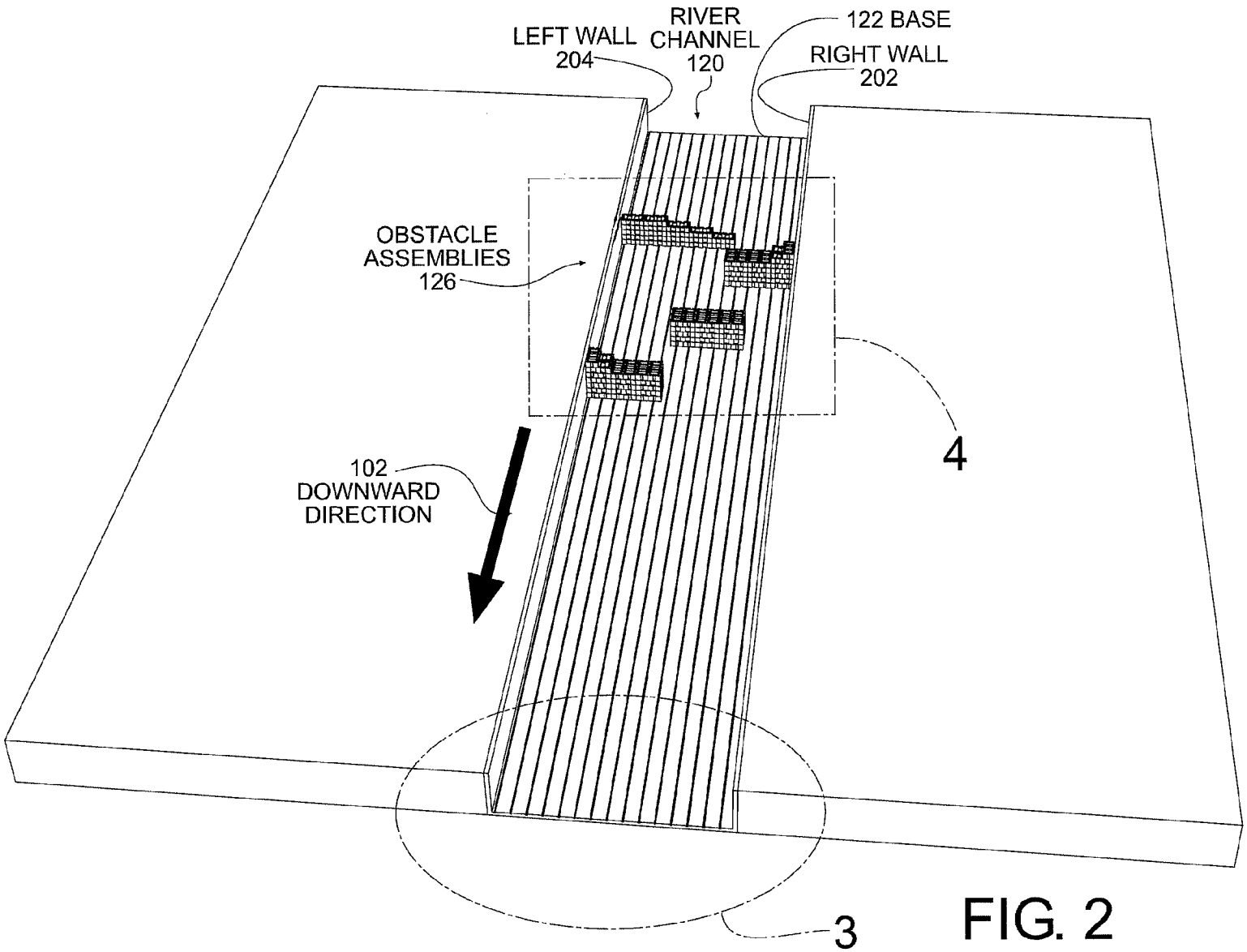
FIG. 2 is a perspective view illustrating a river channel of the river park of FIG. 1 provided with an embodiment of a reconfigurable obstacle system of obstacle assemblies for diverting water in the river channel.

FIG. 2 is a perspective view of the river channel 120 having obstacle assemblies 126. As shown in FIG. 2, the river channel 120 includes a base 122, a left wall 204, and a right wall 202. The base 122, left wall 204 and right wall 202 may be made of any of a variety of durable material, for example, concrete. The base 122 may conform to the topology of the hill wherein water generally flows in downward direction 102, but is illustrated as a flat section for descriptive purposes. The left wall 204 intersects the base 122 at an angle (e.g. perpendicular, or any other angle between vertical and horizontal) and rises above the base 122; for example, approximately six feet or more. The right wall 202 is similar to the left wall 204 as illustrated. The base 122, left wall 204, and right wall 202 create river channel 120 for carrying water in a downward direction 102. Although river channel 120 is shown straight in FIG. 2, it may be curved in one or more directions.

Figure 3A:
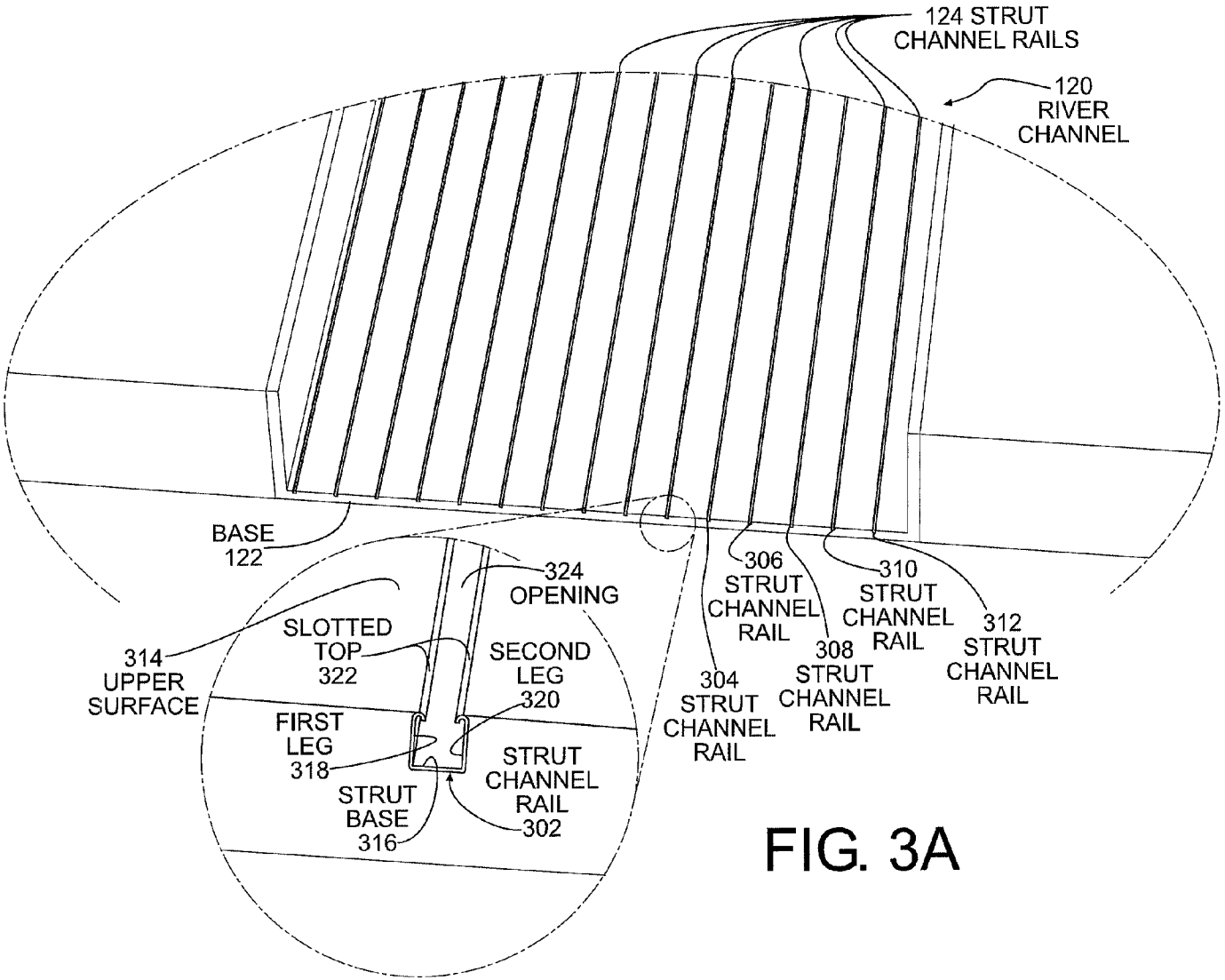
FIG. 3A is a perspective view of a plurality of strut channel rails disposed on a base of the river channel illustrated in FIG. 2 and is a detail indicated by the phantom line 3 in FIG. 2.
Figure 8:
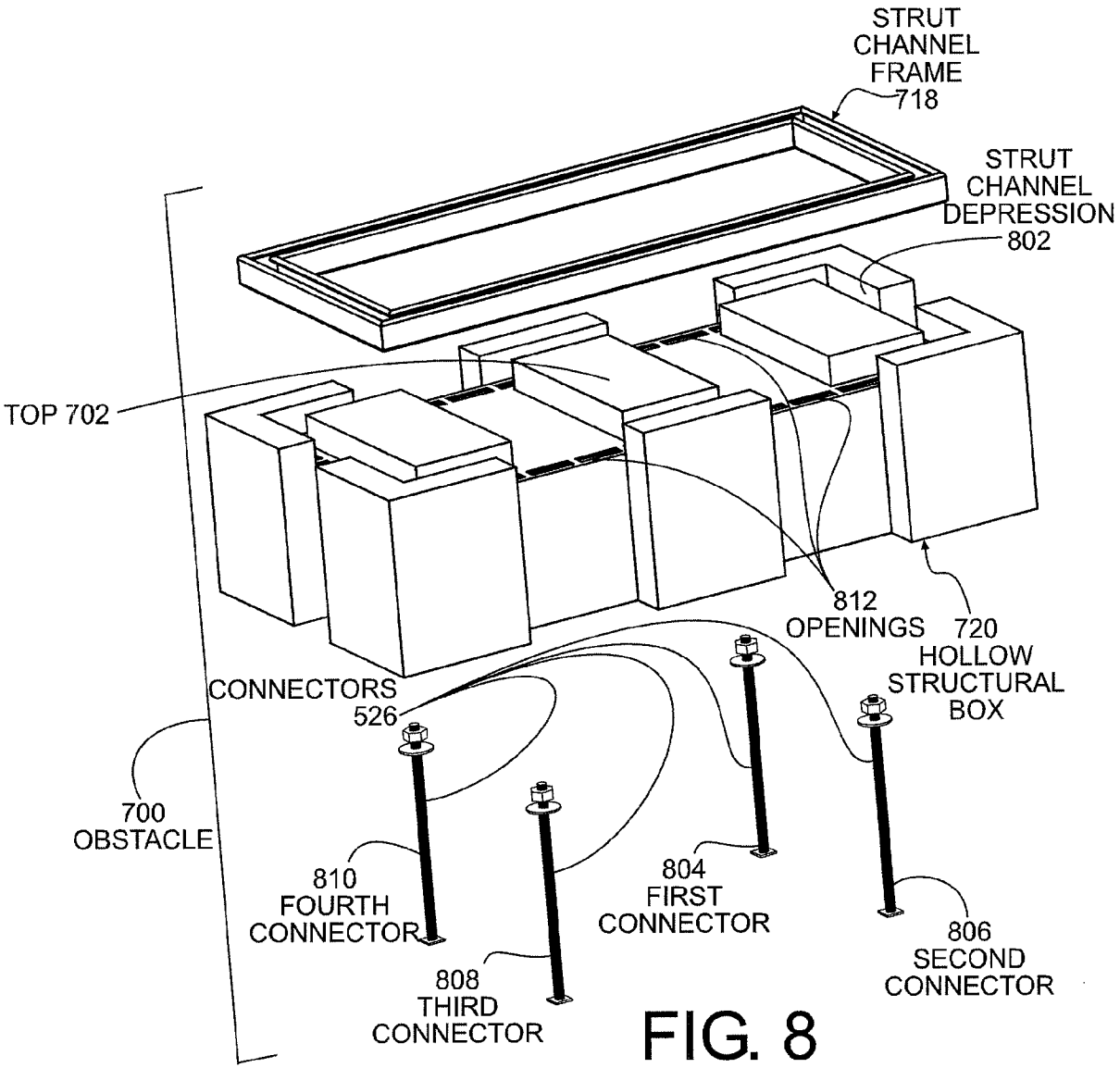
FIG. 8 is an exploded perspective view of the obstacle illustrated in FIG. 7 showing exemplary embodiments of a strut channel frame, a hollow structural box and a plurality of connectors.
Figure 19:
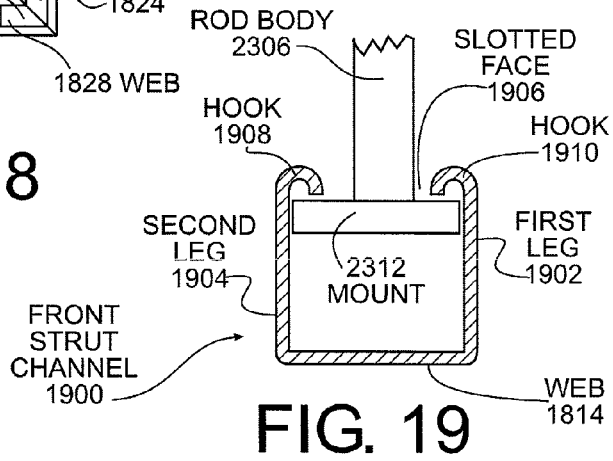
FIG. 19 is a cross-sectional view illustrating the strut channel frame taken across plane 19-19 in FIG. 18 with visible edges suppressed.

FIG. 3A is a perspective view of a plurality of strut channel rails 124 indicated by phantom line 3 in FIG. 2. As shown in FIG. 3A, the plurality of strut channel rails 124 may be embedded in the river channel base 122 or, alternatively, attached to the river channel base 122 in the manner described below. If the strut channel rails 124 are embedded in the river channel base 122, as illustrated in FIG. 3A, the strut channel rails 124 are flush to the upper surface 314 of the base 122 of the river channel 120. The strut channel rails 124 comprise individual strut channel rails 302-312. Although strut channel rails 124 are illustrated as commercially available strut channels, other embodiments can be used which allow an easy connect/disconnect structure for connecting and disconnecting connectors 526 (FIG. 8). Description of strut channel rails 124, e.g. individual strut channel rail 302, is applicable to other strut channel rails 304-312 because of the similarity to the strut channel rail 302. The strut channel rail 302 comprises a strut base 316, a first leg 318, a second leg 320 and a slotted top 322. The first leg 318 and second leg 320 connect substantially perpendicularly to the strut base 316, forming opening 324. The slotted top 322 may be formed by rolling the ends of the first and second legs 318, 320 to create a feature capable of receiving a connector, as illustrated in FIG. 19. When the strut channel rails 124 are cast in place, a removable foam insert (not shown) may be utilized to keep wet cement from entering opening 324. After the concrete has hardened, the removable foam insert can be removed from opening 324 to allow usage of the strut channel rails 124. The strut channel rails 124 can be cast in place during fabrication of the river channel 120 as described and shown in FIG. 3A, or the strut channel rails 124 may be attached to a previously cast base 122 of the river channel 120. If the strut channel rails 124 are attached to the previously cast river channel base 122, the strut channel rails 124 may, for example, be attached with anchors firmly securing the strut channel rails 124 to the base 122, as more fully disclosed with respect to FIG. 19. Whether the strut channel rails are embedded within base 122, or are attached to base 122 by anchors, the strut channel rails 124 may be positioned in any position along the length of the strut channel rails 128. FIG. 3A illustrates the strut channel rails 124 parallel to the flow of water that distribute forces applied to obstacle assemblies 126 (FIG. 2) across the entire length of the strut channel rails 124. The slotted top 322 of the strut channel rail 302 allows obstacle assemblies 126 (FIG. 2) to be attached in a variety of locations in river channel 120. These locations can be changed as required to 'tune' the flow of water in the river channel 120 to create a challenging water park environment.

Figure 3B:
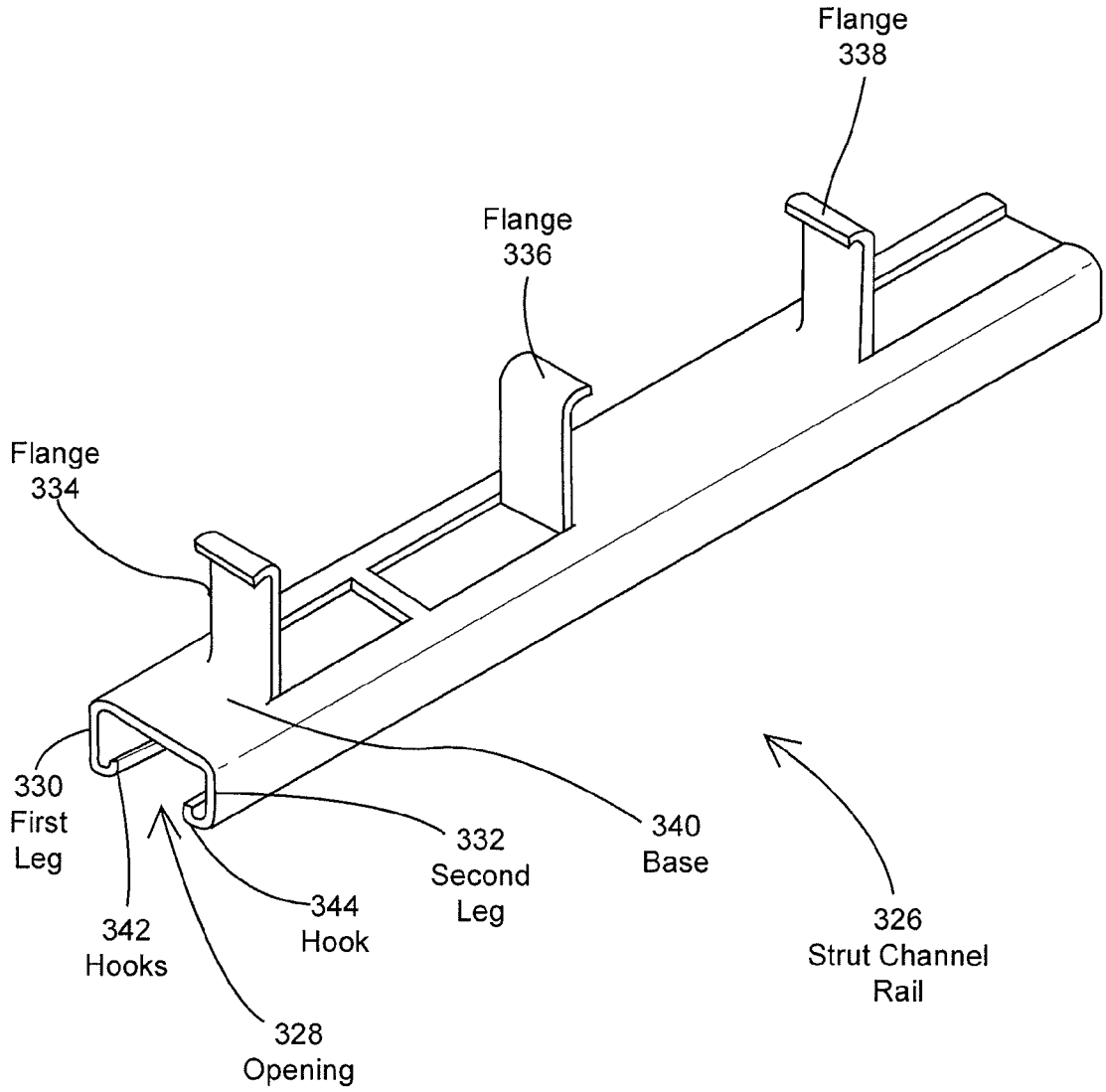
FIG. 3B is an illustration of an alternative strut channel rail.

FIG. 3B is an isometric view of another embodiment of a strut channel rail 326. As shown in FIG. 3B, the strut channel rail has a first leg 330, second leg 332 and a base 340. The first leg 330 and the second leg 332 form an opening 328. The first leg 330 and the second leg 332 have curved shapes that form hooks 342, 344. Flanges 334, 336, 338 are formed from the base portion 340. Flanges 334-338 assist in anchoring the strut channel rail 326 in the base 122 (FIG. 3A) when the base 122 is formed. For example, strut channel rail 326 may be positioned in concrete so that flanges 334-338 hold the strut channel rail 326 in the hardened concrete.

Figure 3C:
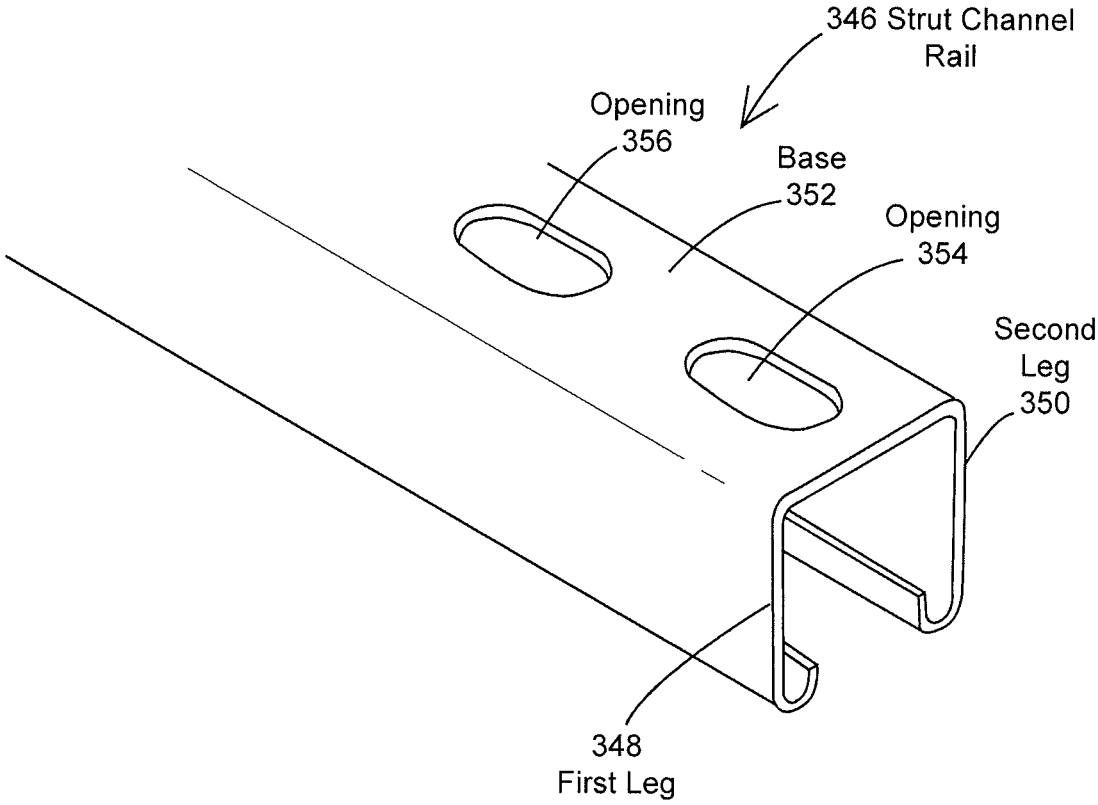
FIG. 3C is another embodiment of the strut channel rail that can be used for modifying an existing river bed.

FIG. 3C illustrates another embodiment of a strut channel rail 346. As shown in FIG. 3C, the strut channel rail 346 comprises a first leg 348, a second leg 350 and a base 352. Openings are formed in the base 352, such as openings 354, 356. Strut channel rail 346 can be used as a channel rail for modifying an existing river channel, such as river channel 120 illustrated in FIG. 2 to include strut channel rails.

Figure 3D:
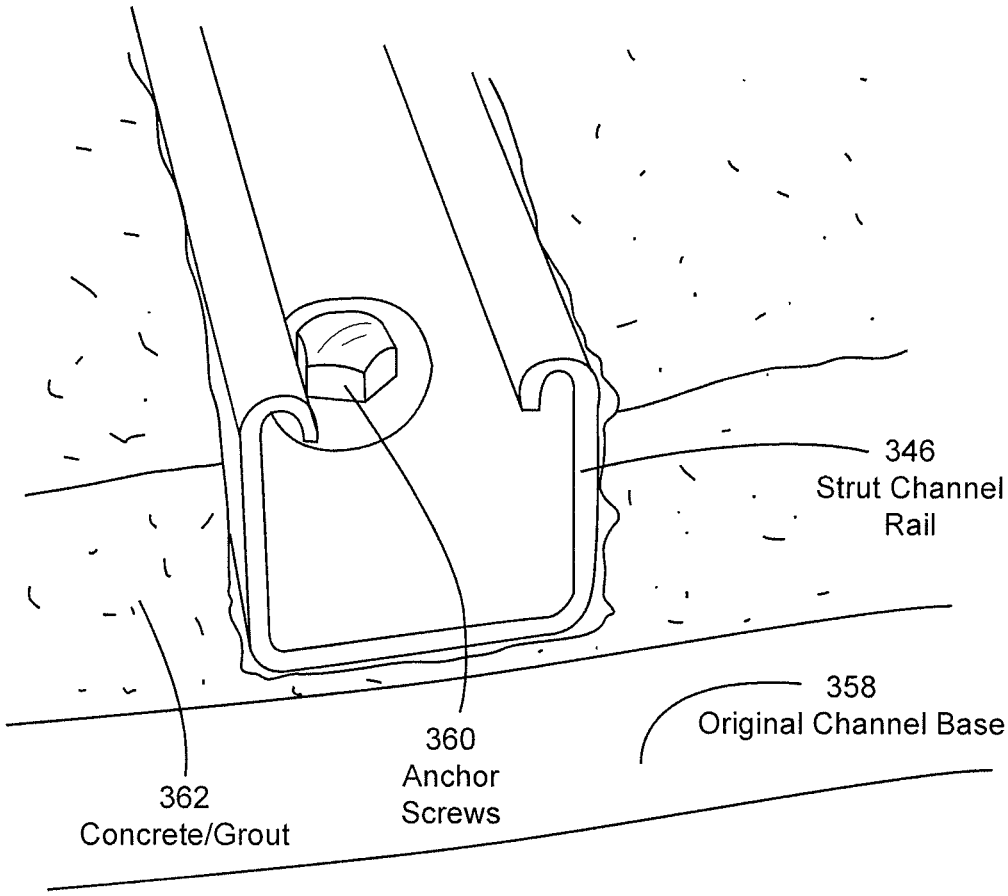
FIG. 3D is an illustration of an example of a modified river channel.

FIG. 3D is an illustration of an example of the manner in which a strut channel rail, such as strut channel rail 346, can be used to modify an existing river channel 120. As shown in FIG. 3D, the strut channel rail 346 is anchored to the original channel base 358 using anchor screws 360. Once the strut channel rails 346 are installed on the original channel base 358, concrete or grout 362 is used to fill in the portions surrounding the strut channel rail 346.

Figure 4:
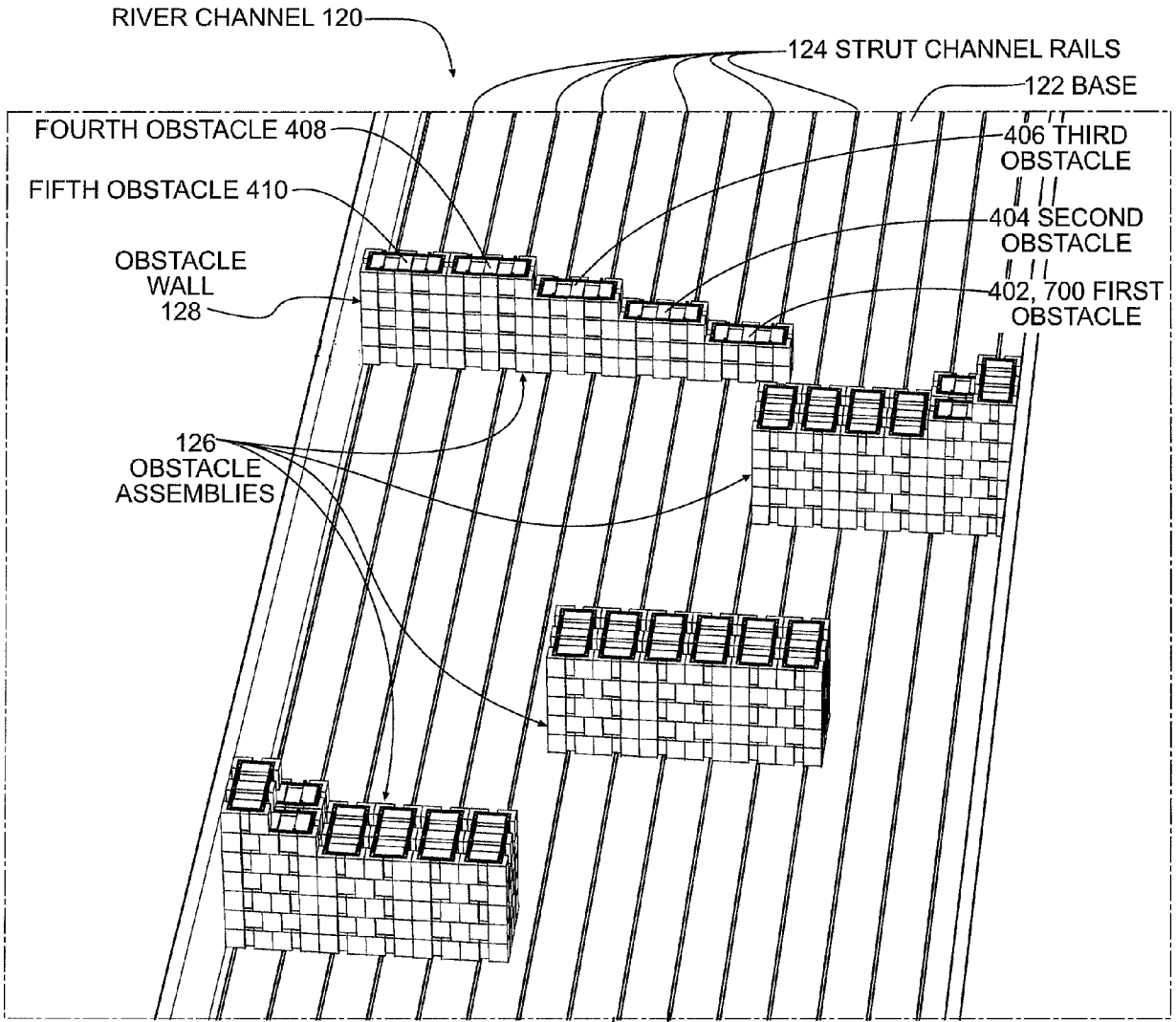
FIG. 4 is a perspective view of the obstacle assemblies illustrated in FIG. 2 and is a detail indicated by the phantom line 4 in FIG. 2.

FIG. 4 is an illustration indicated by the phantom line 4 in FIG. 2 of obstacle assemblies 126, attached to strut channel rails 124, of the river channel 120. Although a large number and variety of sizes and geometries of obstacle assemblies 126 can be assembled, exemplary embodiments are provided for illustrative purposes, and it is to be understood that other configurations can be created as required. As illustrated in FIG. 4, one exemplary embodiment of the obstacle assemblies 126 is the obstacle wall 128 which comprises first obstacle 402, 700, second obstacle 404, third obstacle 406, fourth obstacle 408, and fifth obstacle 410. The obstacle assemblies 126 can be attached to the river channel 120 in any of a variety of configurations. For example, the obstacle wall 128 is attached to the river channel 120 via the strut channel rails 124 to form a single row of obstacles while other obstacle walls use multiple rows.

Figure 5:
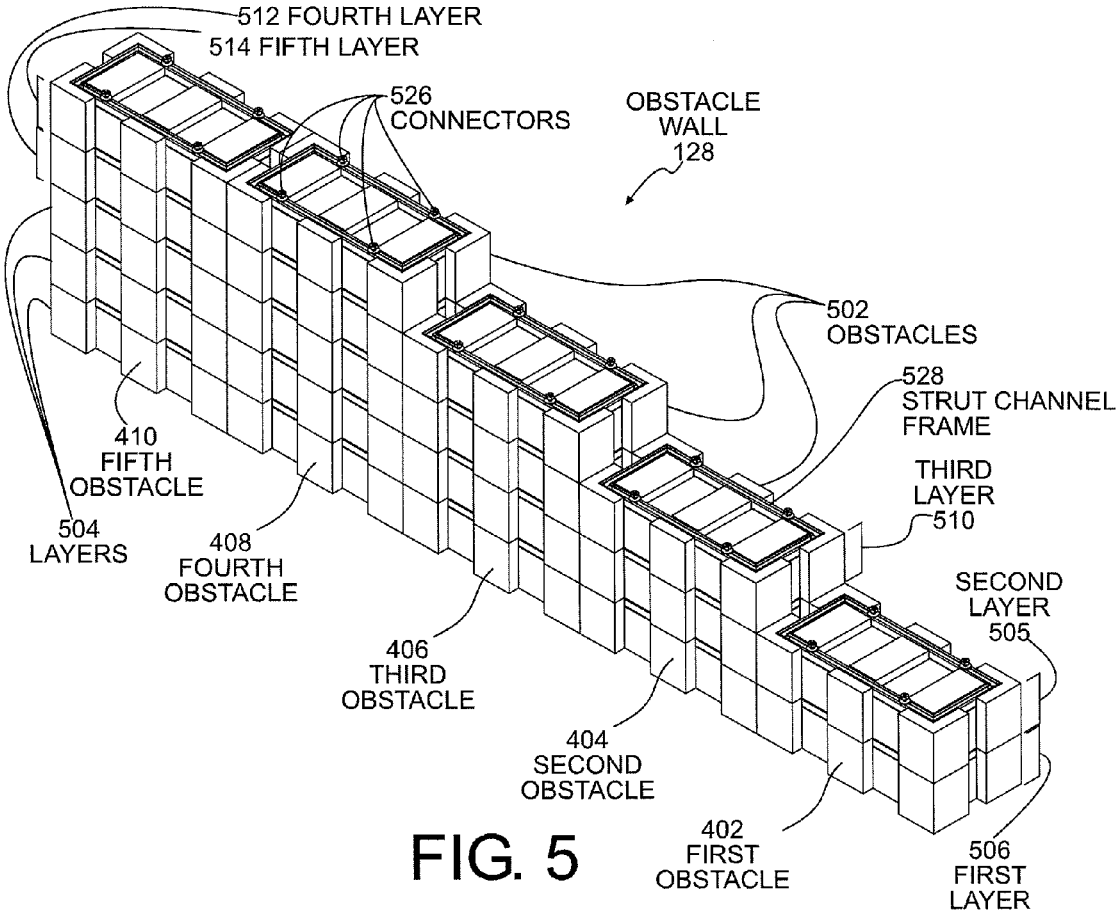
FIG. 5 is a perspective view illustrating an embodiment of an exemplary obstacle wall of the obstacle assemblies illustrated in FIG. 4.

FIG. 5 is a perspective view of the embodiment of the obstacle wall 128 illustrated in FIG. 4. As illustrated in FIG. 5, the obstacle wall 128 is made of a plurality of individual obstacles 502 formed in layers 504. The obstacle wall 128 illustrated in FIG. 5 includes a first layer 506, a second layer 508, a third layer 510, a fourth layer 512, and a fifth layer 514. Each of the layers 504 has a plurality of individual obstacles 502, as mentioned above. For example, the first layer 506 has a first obstacle 402, a second obstacle 404, a third obstacle 406, a fourth obstacle 408, and a fifth obstacle 410. The obstacles 402-410 of the first layer 506 are aligned end-to-end to create a contiguous section of the obstacle wall 128. In a similar manner, other layers 504 have individual obstacles 502. For example, to assemble obstacle wall 128, first layer 506 is attached to strut channel rails 124 of river channel base 122 (shown in FIG. 3), wherein first layer 506 includes first obstacle 402, second obstacle 404, third obstacle 406, fourth obstacle 408, and fifth obstacle 410. In a similar manner, the individual obstacles 502 of the second layer 508 are attached to the first layer 506. In that regard, connectors 526 are connected to the strut channel frame 528 of the obstacles in the first layer 506. In a similar manner, the third layer 510 is attached to the second layer 508, the fourth layer 512 is attached to the third layer 510, and the fifth layer 514 is attached to the fourth layer 512. The layers 506-514 are physically attached to the layer located beneath, e.g., second layer 508 is attached to first layer 506. Physical attachment of adjoining layers is accomplished via the connectors 526 spanning through the obstacles 502 and attaching to the layer below, via mounts located at the bottom of the connectors 526 and the strut channel frame 528.

Figure 6:
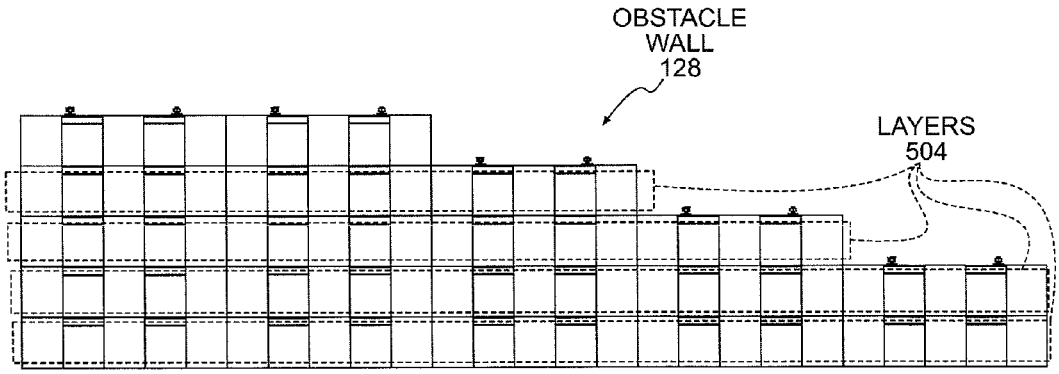
FIG. 6 is a side elevation view illustrating the obstacle wall of FIG. 5.

FIG. 6 is a side elevation view of the obstacle wall 128 illustrated in FIG. 5. As shown in FIG. 6, the obstacle wall 128 has individual layers 504 that are stacked and attached to each other to form the obstacle wall 128. The blocks fit together in a manner that supports the wall structure.

Figure 7A:
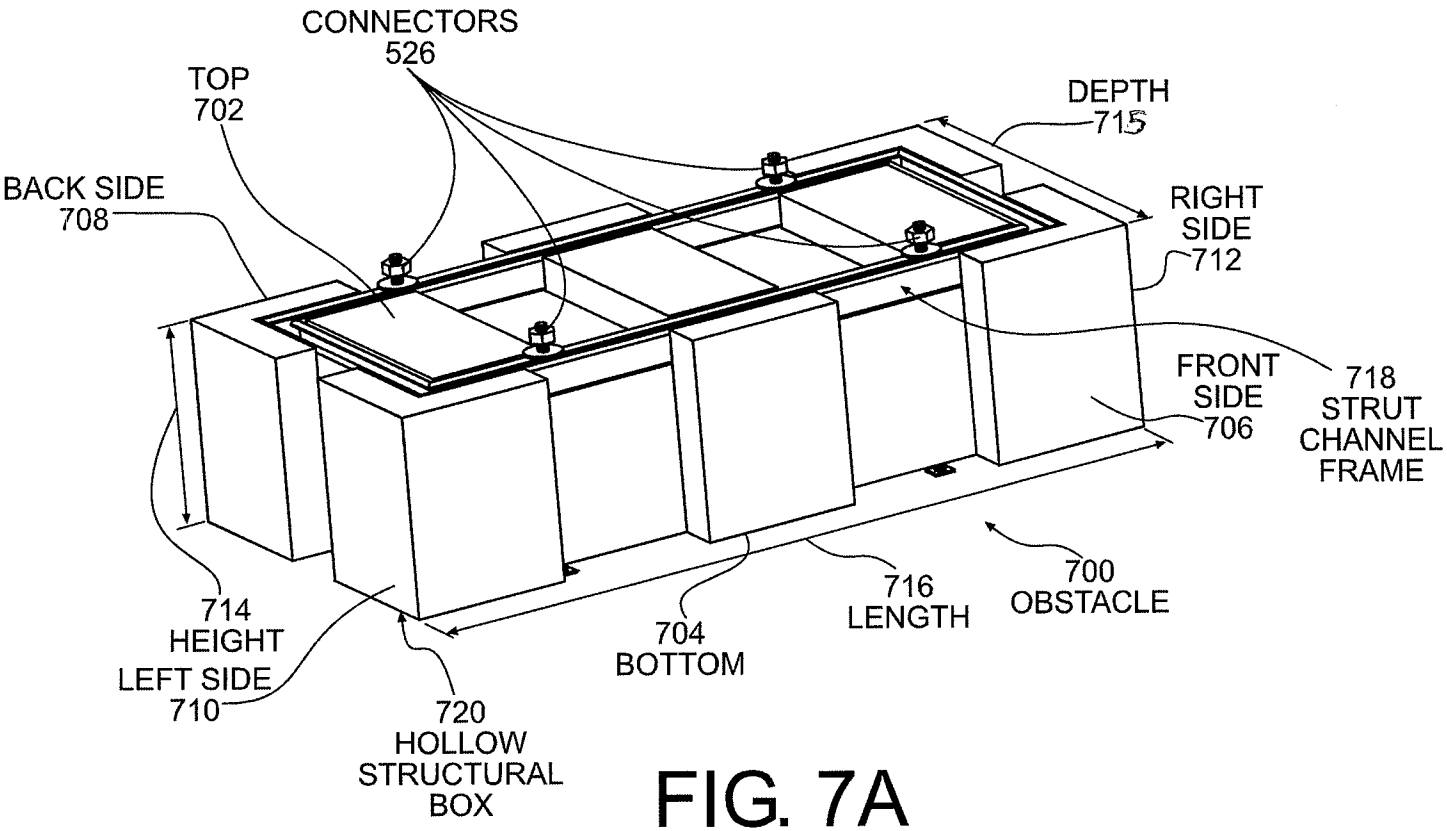
FIG. 7A is a perspective view illustrating an exemplary obstacle of the obstacle wall illustrated in FIG. 5.

FIG. 7A is a perspective view of an exemplary obstacle 700 that is substantially identical to the other obstacles 402-410

(shown in FIG. 5). Although the exemplary obstacle 700 is described and illustrated as a rectangular object, other volume-creating shapes may also be utilized such as square, circular, triangular etc. The obstacle 700 is a volume-creating shape that has flat surfaces for creating turbulence when installed in the river channel 120 (shown in FIG. 1). As illustrated in FIG. 7A, the obstacle 700 comprises a top 702, a bottom 704, a front side 706, a back side 708, a left side 710, and a right side 712. The top 702 and the bottom 704 are parallel to each other and separated by a height 714. The top 702 and bottom 704 are separated by the front side 706, back side 708, left side 710, and right side 712. The front side 706 and the back side 708 are parallel to each other and separated by a depth 715. The left side 710 and the right side 712 are parallel to each other and separated by a length 716. In one exemplary embodiment, the height 714 is about ten inches (10"), the depth 715 is about twenty inches (20") and the length 716 is about forty inches (40"). The obstacle 700 includes a strut channel frame 718, a hollow structural box 720, and a plurality of connectors 526. In general terms, the strut channel frame 718 is located on the top 702 of the obstacle 700, the hollow structural box 720 is located in the middle of the obstacle 700 and the plurality of connectors 526 extend from the bottom 704 to the top 702 of the obstacle 700. When assembled as illustrated in FIG. 7A, the strut channel frame 718 fits into a strut channel depression 802 (FIG. 8) of the hollow structural box 720 such that openings 1812, 1826, 1840, 1854 (FIG. 18) in the strut channel frame 718 register with top openings 812 (FIG. 12) in the hollow structural box 720. The aligned openings in the strut channel frame 718 and hollow structural box 720 receive the connectors 526 as described later.

Figure 7B:
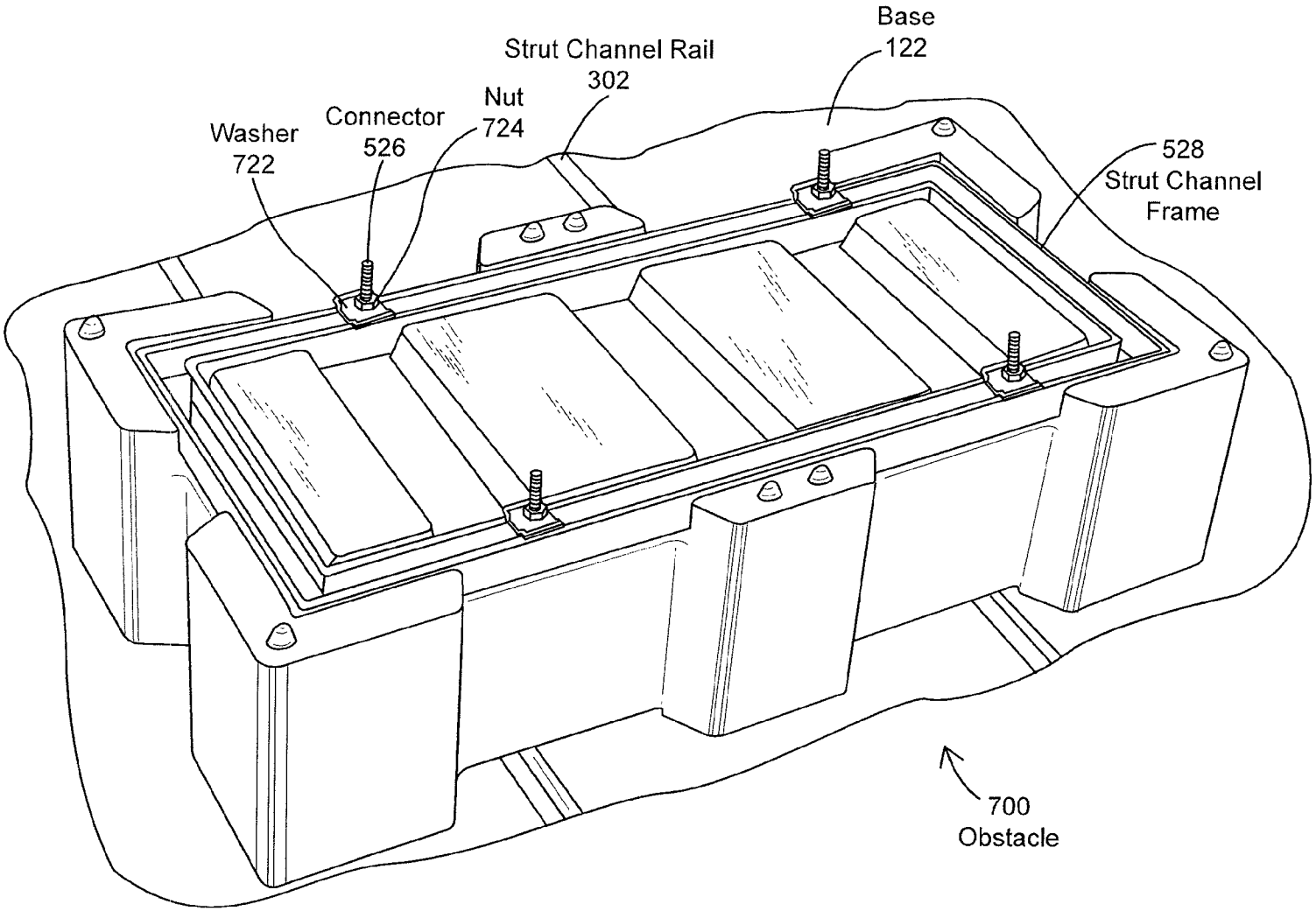
FIG. 7B is an illustration of an obstacle that is secured to a base.

FIG. 7B is another view of the obstacle 700, which is shown attached to base 122. As illustrated in FIG. 7B, the base 122 has strut channel rails formed therein, such as strut channel rail 302. The obstacle 700 is coupled to the strut channel rail 302 via connector 526. Connector 526 may comprise a threaded shaft with a nut 724, which is tightened onto washer 722. Washer 722 forces the strut channel frame 528 onto the surface of the obstacle 700 to hold the obstacle 700 to the strut channel rail 302 and base 122.

Figure 7C:
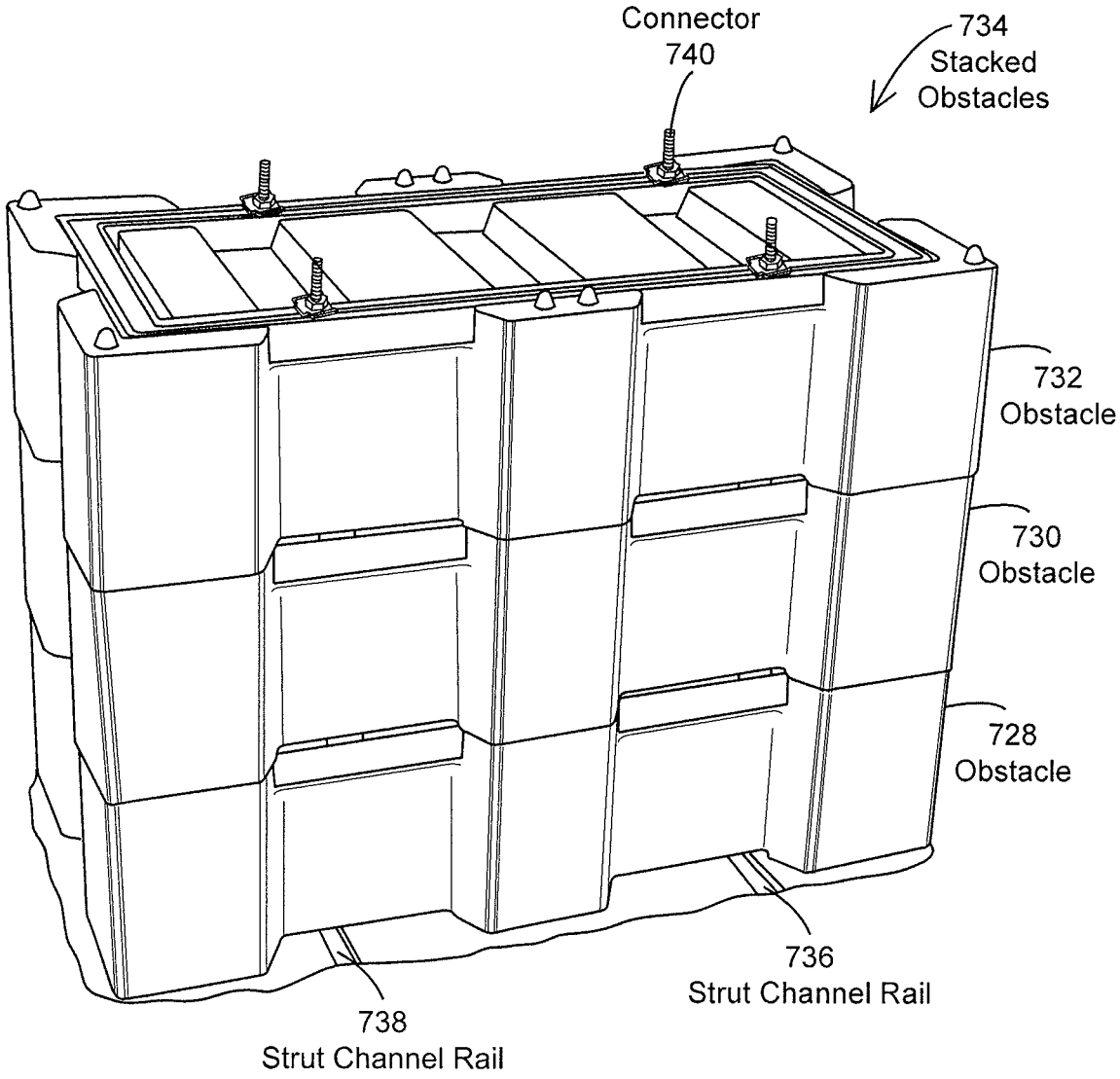
FIG. 7C is an illustration of a plurality of stacked obstacles.

FIG. 7C illustrates a stacked obstacle 734. The stacked obstacle 734 comprises obstacle 728, obstacle 730 and obstacle 732. Obstacle 728 is coupled to the strut channel rails 736, 738 in the manner described with respect to FIG. 7B. Obstacle 730 is coupled to the strut channel frame of obstacle 728, such as strut channel frame 528 illustrated in FIG. 7B. Similarly, obstacle 732 is coupled to the strut channel frame of obstacle 730 using connectors such as connector 740.

Figure 7D:
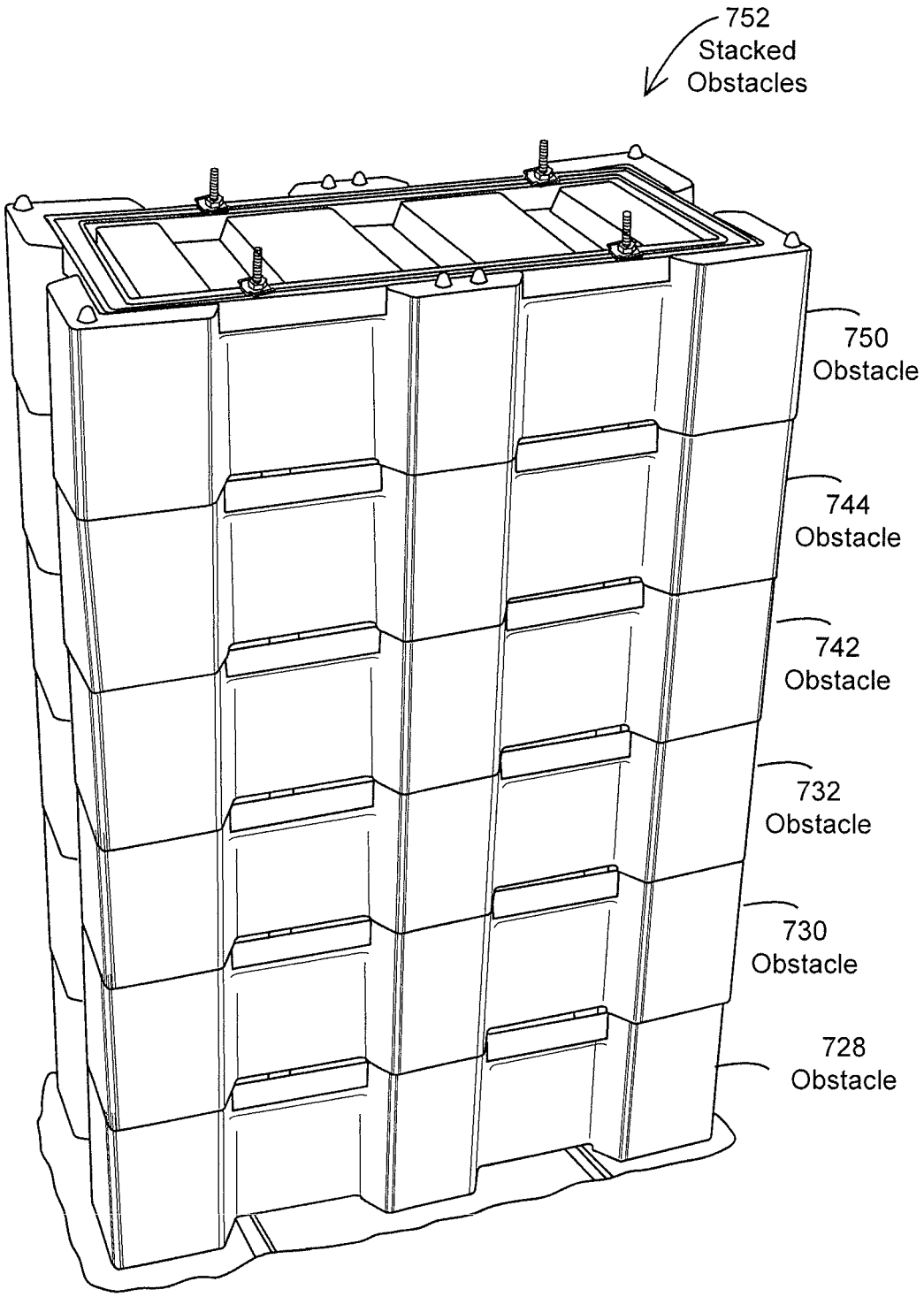
FIG. 7D is another illustration of a plurality of stacked obstacles.

FIG. 7D is an illustration of the manner in which a plurality of obstacles can be connected to form a wall or tower. Obstacles 728, 730, 732 are coupled together in the manner illustrated in FIG. 7C. Similarly, obstacles 742, 744, 750 are connected to one another in form the plurality of stacked obstacles 752 illustrated in FIG. 7D. This process can be repeated to create a wall of stacked obstacles of a desired height.

Figure 7E:
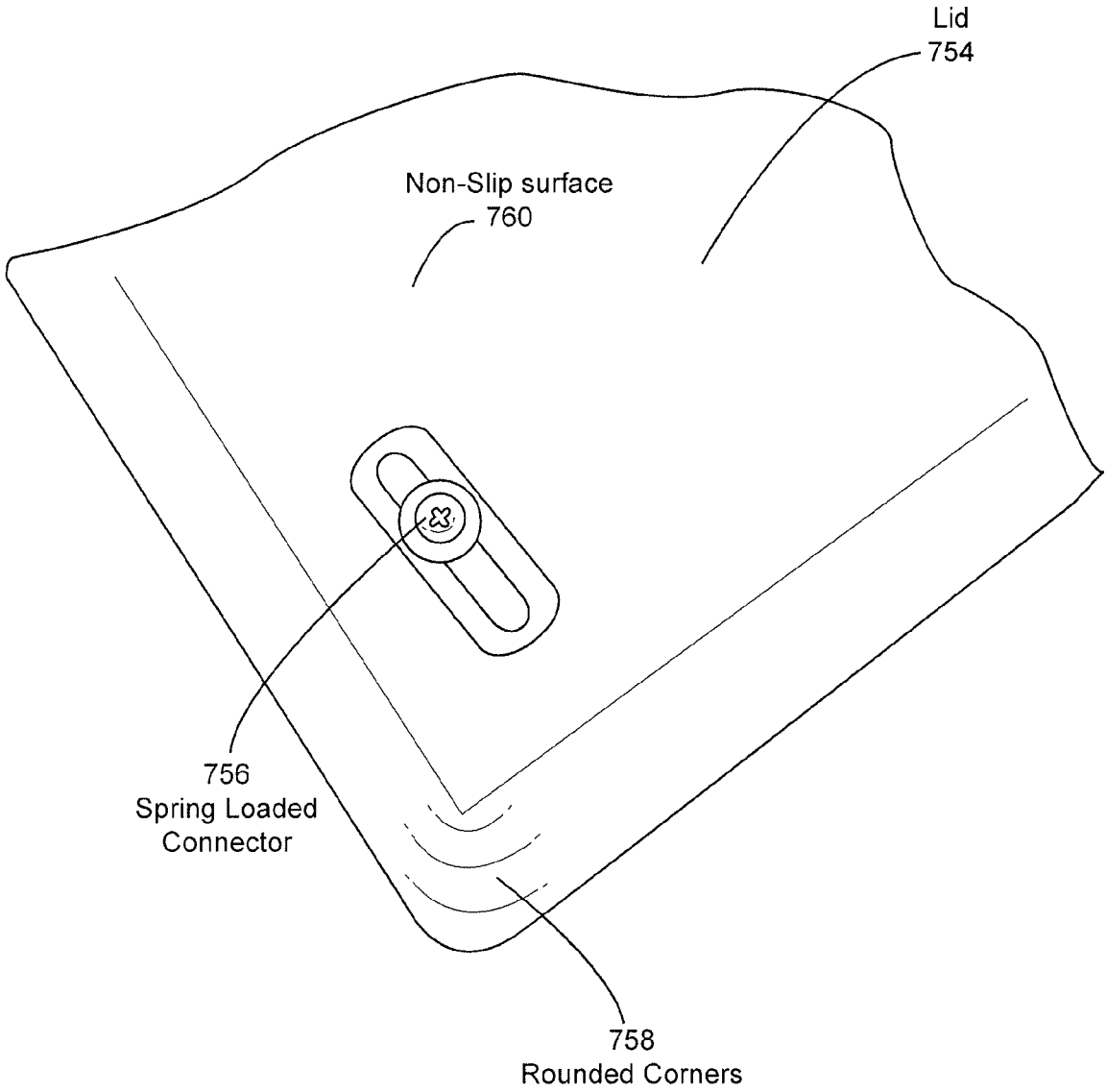
FIG. 7E is an illustration of a lid that can be placed on top of the stacked obstacles.

FIG. 7E is an illustration of a lid 754. As illustrated in FIGS. 7B, 7C and 7D, the connectors extend from the top portion of the stacked obstacles. For example, in FIG. 7C, connector 740 extends upwardly from stacked obstacle 734. It is desirable to protect the users of a river park, such as river park 100 (FIG. 1) from being injured on the connectors. Hence, a lid 754 can be provided, which covers the connectors that extend upwardly from the stacked obstacles. Spring loaded connectors, such as spring loaded connector 756, can be used which couples to the strut channel frame of the top obstacle. Four spring loaded connectors, such as spring loaded connector 756, can be used to anchor the lid 754 to the top stack obstacle, such as obstacle 750 in FIG. 7D. The lid 754 has rounded corners 758 to prevent injury. In addition, a non-slip surface 760 can be molded into the top surface of the lid 754 to assist in preventing slips and falls by a user of the river park.

Figure 7F:
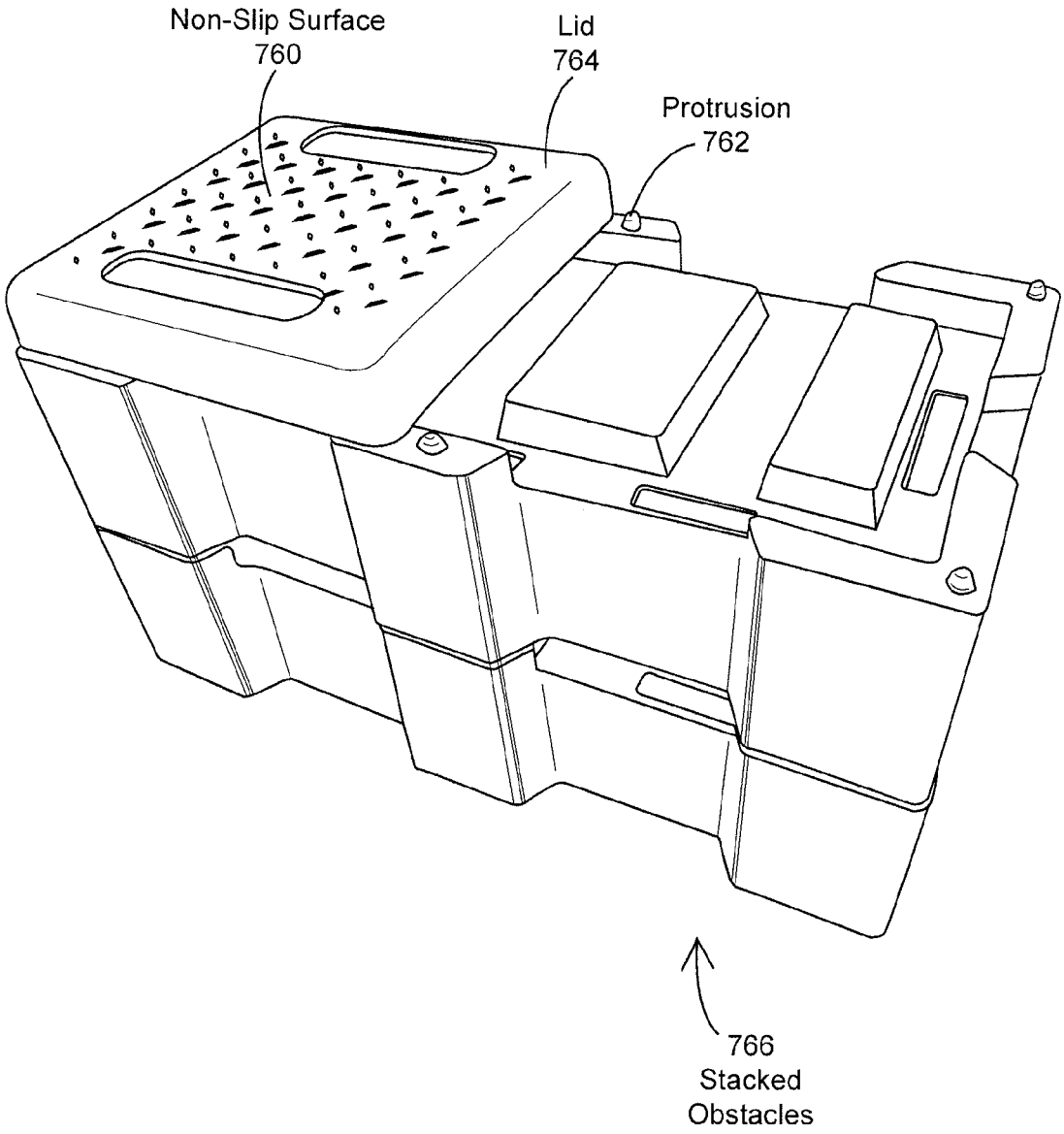
FIG. 7F is a perspective view of stacked obstacles and a lid.

FIG. 7F is a perspective view of a plurality of stacked obstacles 766 and a lid 764. Lid 764 is disposed on top of the stacked obstacles 766. Protrusions, such as protrusion 762, on the top surface of the top layer of the stacked obstacles 766 mates with a depression or opening (not shown) in the lid 764. As also shown in FIG. 7F, the lid 764 has a non-slip surface 760.

Figure 7G:
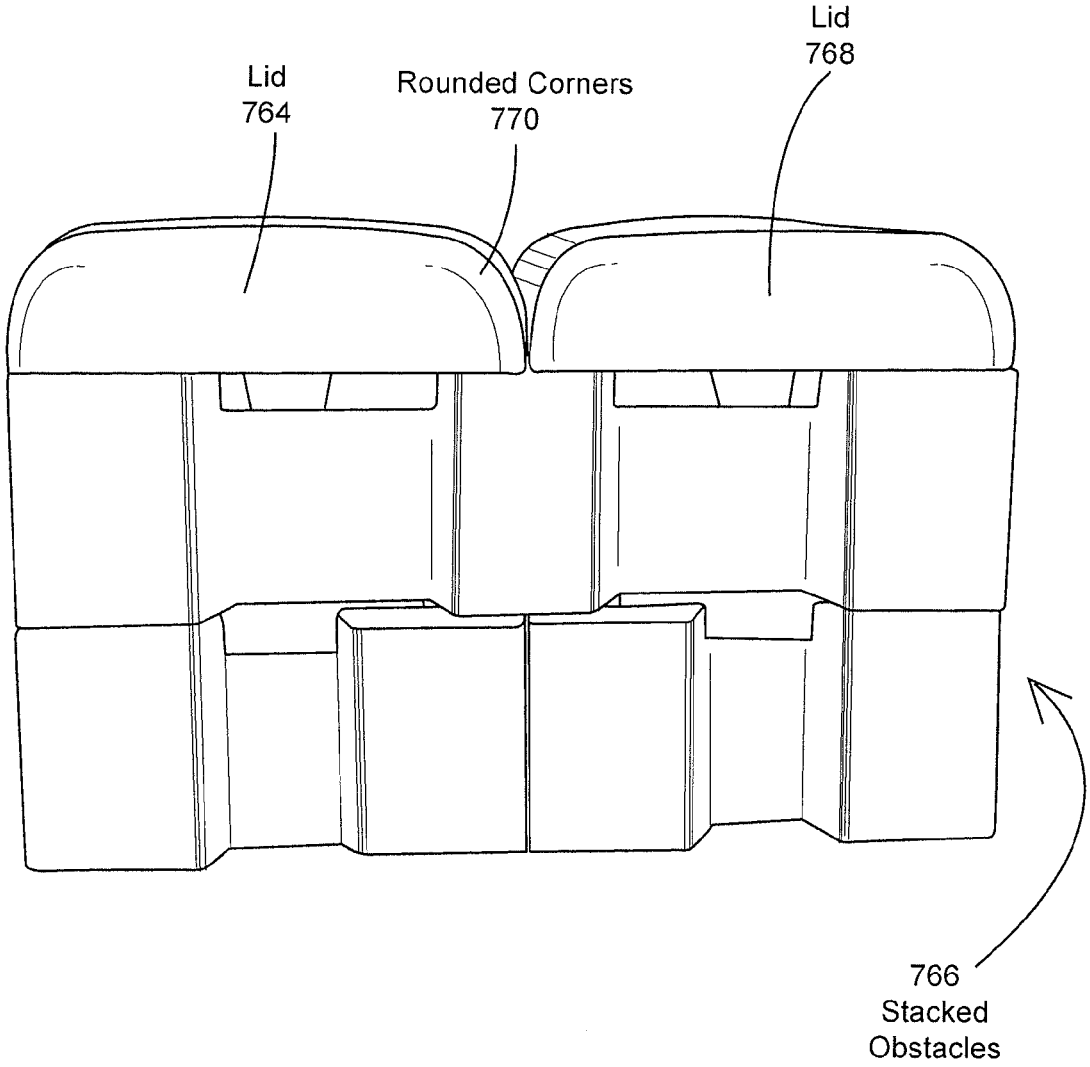
FIG. 7G is a side view of stacked obstacles with lids placed on the top surface of the stacked obstacles.

FIG. 7G is a side view of the stacked obstacles 766 with lid 764 and lid 768 disposed on the top of the stacked obstacles 766. As shown in FIG. 7G, the lids 764, 768 have rounded corners to prevent injury by a user of the water park 100 that may either slide across the top surface of the stacked obstacles 766 or stand on the top surface of the stacked obstacles 766.

Figure 18:
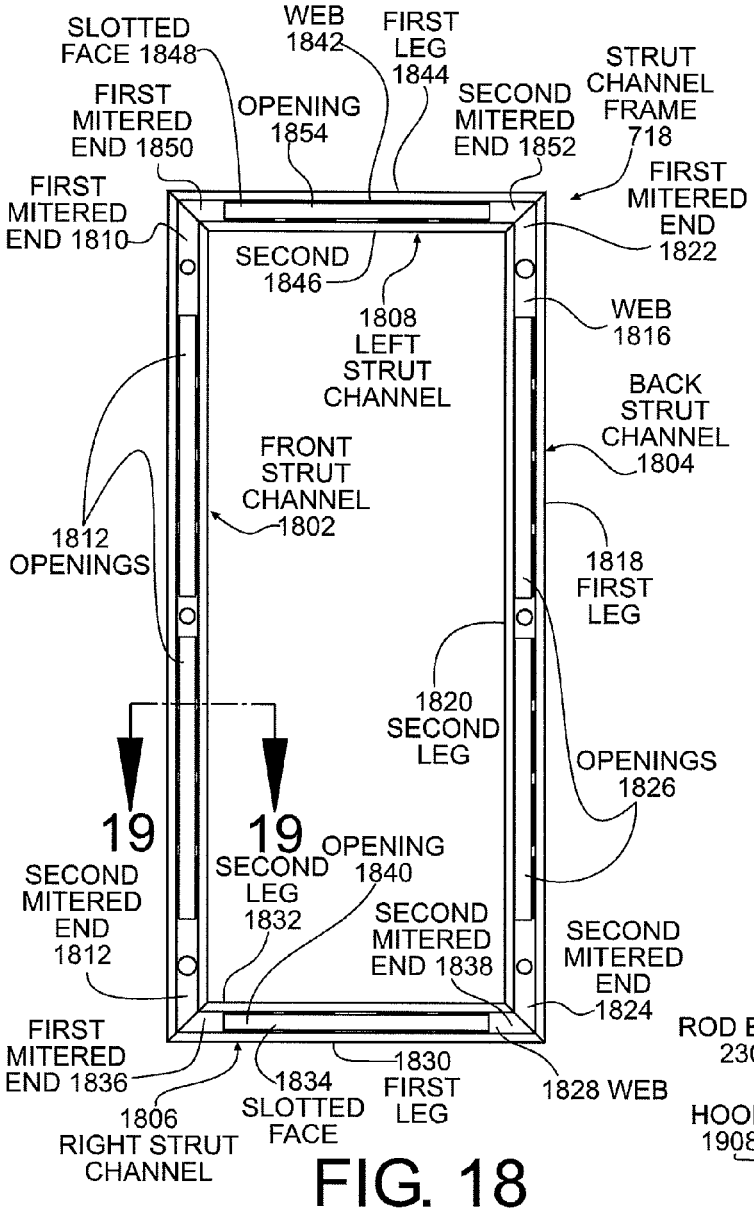
FIG. 18 is a top plan view illustrating the strut channel frame of FIG. 8.

FIG. 8 is an exploded perspective view of the obstacle 700 illustrated in FIG. 7. As illustrated in FIG. 8, the strut channel frame 718, the hollow structural box 720, and the plurality of connectors 526 may be assembled when hollow structural box is still hot (above 130 degrees Fahrenheit) so that the strut channel frame 718 is pushed into the strut channel frame depression 802. The strut channel frame 718 is orientated so that the webs 1814, 1816, 1828, 1842 (FIG. 18) of the strut channels 1802, 1804, 1806, 1808 (FIG. 18), respectively, contact the bottom of the strut channel depression 802 and the plurality of top openings 812 (FIG. 12) of the hollow structural box 720 are aligned with the openings in the strut channels 1802, 1804, 1806, 1808 (FIG. 18). When fully pushed into the strut channel depression 802, the top surface of the strut channel frame 718 is flush with the top 702 of the hollow structural box 720. Cooling of the hollow structural box 720, results in shrinkage that firmly attaches the strut channel frame 718 to the hollow structural box 720. Next, the plurality of bottom openings 1112 (FIG. 11) are cut into the hollow structural box 720 as previously described. Then the first connector 804, second connector 806, third connector 808, and fourth connector 810 can be attached to the hollow structural box 720 and the strut channel frame 718 attached thereto. Alternatively, hollow structural box 720 can be molded and riveted and strut channel frame 718 can be disposed into strut channel depression 802 while hollow structural box is not hot (i.e. not above 130 degrees Fahrenheit), and connectors 804-810 can attach strut channel frame 718 to hollow structural box 720.

Since in one exemplary embodiment, the obstacles 402-410 are substantially the same, the process of installing obstacles, such as obstacle 700 to the river channel base 122, it is to be understood that the other obstacles are attached in the same manner. Assuming that first obstacle 402 is obstacle 700, it is attached to the base 122 by connecting the mounts (e.g. first connector mount 2312, FIG. 24) of the first connector 804 (FIG. 8) and the second connector 806 (FIG. 8) to the strut channel rail 304 and the mounts of the third connector 808 (FIG. 8) and the fourth connector 810 (FIG. 8) to the strut channel rail 302. After the connectors 804-810 are interfaced with the strut channel rails 304, 302, the bottom 704 (FIG. 7) of the obstacle 700 contacts the base 122 of the river channel 120. The fasteners (e.g. first connector fastener 2314, FIG. 23) of the connectors 804-810 are tightened to place the connectors into tension. The reaction force to the tension in the connectors creates compression on the hollow structural box 720. The reaction force that compresses the hollow structural box 720 is beneficial for several reasons. First, the reaction force is a normal force between the bottom 704 (FIG. 7) of the obstacle 700 and the base 122 of the river channel 120. The normal force and a relatively high coefficient of friction cause a friction force that is greater than the force of the water traveling down the river channel 120. As such, the obstacle 700 does not move when it is diverting water flowing in the river channel 120. After the obstacle 700, also referred to as first obstacle 402, is attached to the river channel base 122, the second obstacle 404 can be attached to the base 122 of the river channel 120. In a similar manner, the third obstacle 406, fourth obstacle 408, and fifth obstacle 410 are also attached to the river channel 120. Attachment of these obstacles 402, 404, 406, 408, and 410 creates the first layer 506 of the obstacle wall 128.

Figure 9:
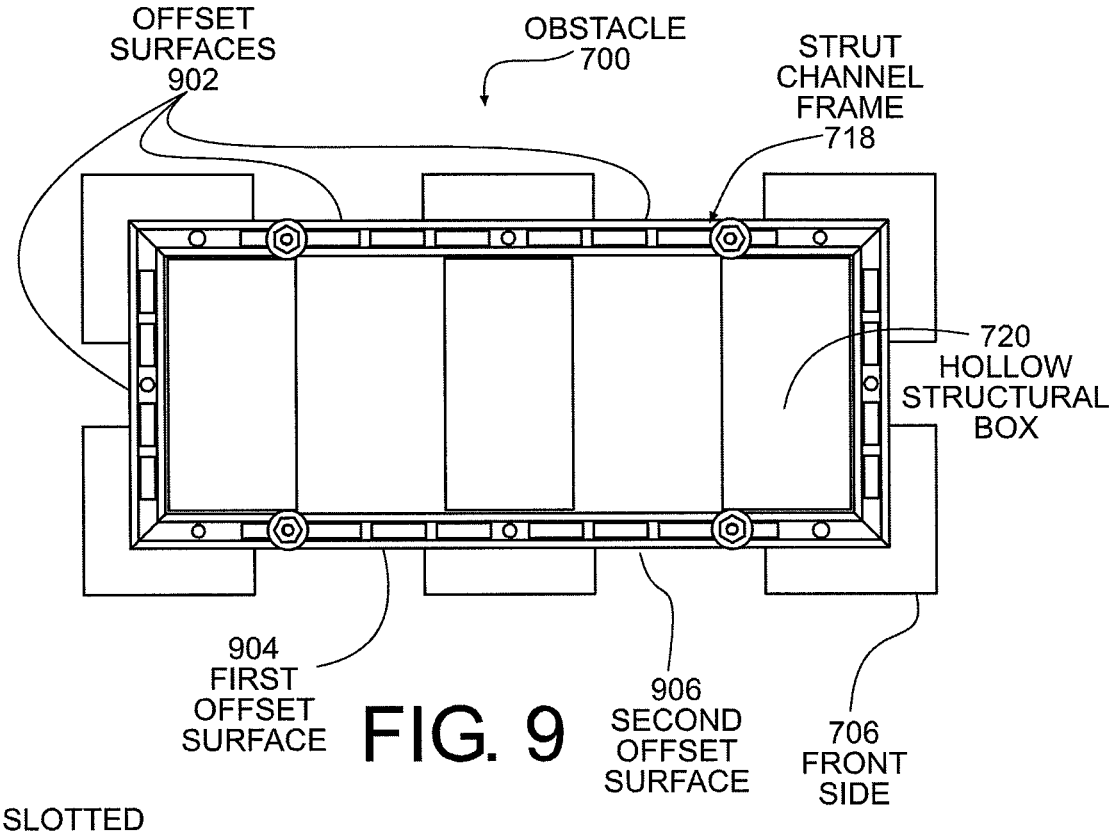
FIG. 9 is a top plan view illustrating the obstacle of FIG. 7.

FIG. 9 is a top plan view of the obstacle 700 illustrated in FIG. 7. As illustrated in FIG. 9, the obstacle 700 forms a generally rectangular shape having a plurality of offset surfaces 902 such as, for example, a first offset surface 904 and a second offset surface 906. The offset surfaces 904, 906 are formed parallel to and offset from the front side 706. The offset surfaces 902 (specifically offset surfaces 904, 906) and their walls disrupt the planar geometry and increase the loading capacity of the hollow structural box 720 by helping to prevent failure due to buckling. FIG. 7 also shows strut channel frame 718.

Figure 10:
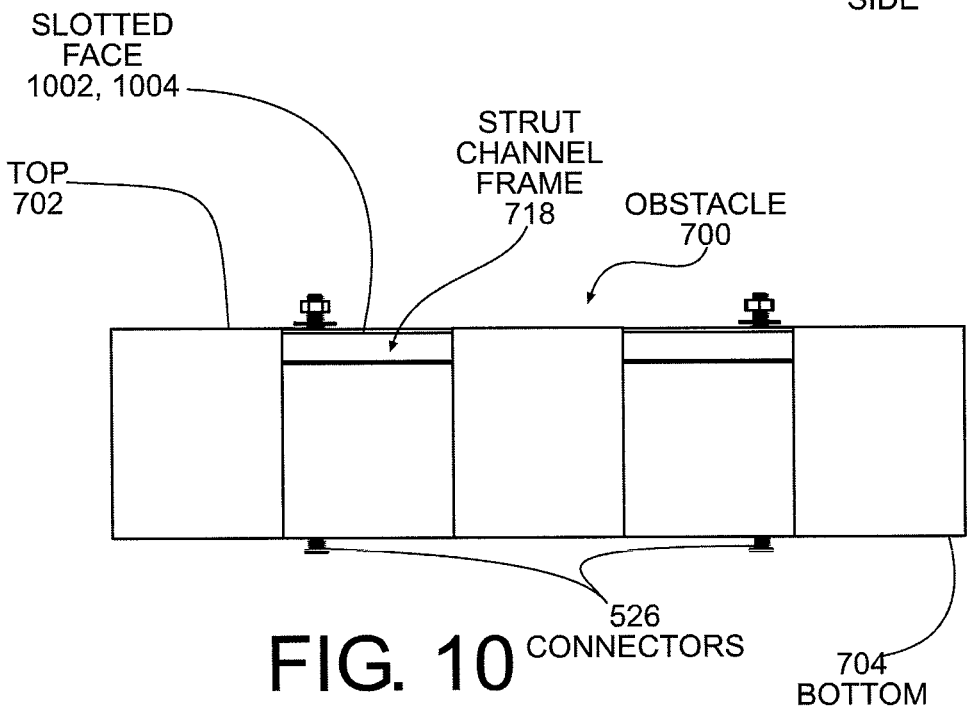
FIG. 10 is a front side elevation view illustrating the obstacle of FIG. 7.

FIG. 10 is a front side elevation view of the obstacle 700 illustrated in FIG. 7. As illustrated in FIG. 10, the slotted faces 1002, 1004 of the strut channel frame 718 are coplanar to the top 702 of the obstacle 700. Additionally, the connectors 526 are extending from the bottom 704 and the top 702 of the obstacle 700.

Figure 11:
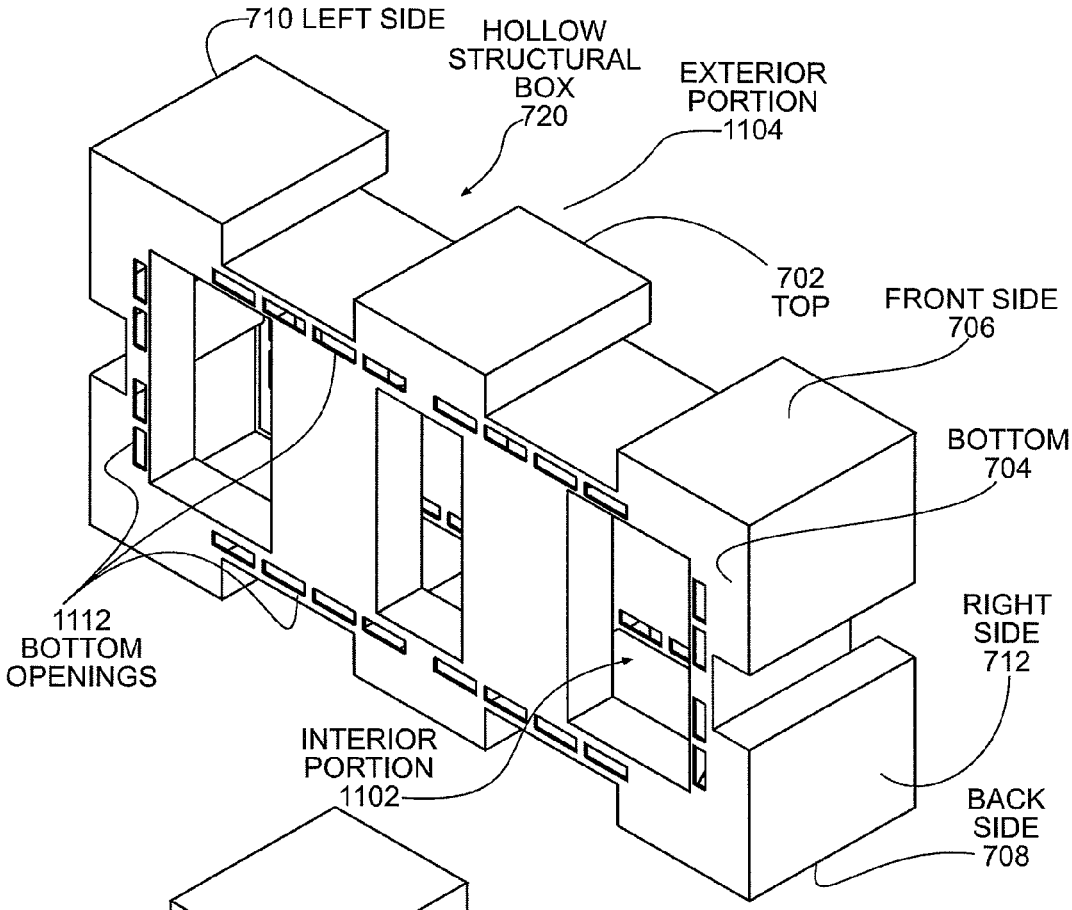
FIG. 11 is a perspective view illustrating the bottom surface of the hollow structural box of FIG. 8.

FIG. 11 is a perspective view of the hollow structural box 720 illustrated in FIG. 8. As illustrated in FIG. 11, the hollow structural box 720 defines a top 702, a bottom 704, a front side 706, a back side 708, a left side 710, and a right side 712. The top 702 and the bottom 704 are parallel to each other. The top 702 and bottom 704 are separated by the front side 706, back side 708, left side 710, and right side 712. The front side 706 and the back side 708 are parallel to each other. The left side 710 and the right side 712 are parallel to each other. The hollow structural box 720 is made of relatively thin wall material such as, for example, plastic. In one exemplary embodiment, the hollow structural box 720 is made of high density polyethylene 'HDPE' by a process called rotation molding. Rotation molding requires a multi-body cavity made of metal that, when fastened together, creates a cavity that is the negative of the geometry of the hollow structural box 720. The multi-body cavity fastened together encapsulating a predetermined quantity of a thermoplastic (e.g. HDPE) and then subjected to an elevated temperature while the cavity is rotated. The elevated temperature of the multi-body cavity transfers heat to the thermoplastic causing the predetermined quantity of thermoplastic to transition from rigid plastic pellets to a fluid viscous state. While fluid, the plastic coats the inside of the multi-body cavity as the multi-body cavity rotates in multiple orientations. Once the fluid plastic has coated the inside of the multi-body cavity, the cavity and the coated plastic are removed from the heat and allowed to cool towards a temperature when the plastic is rigid enough to be removed from the multi-body cavity. In one exemplary scenario, this temperature is about one hundred and thirty degrees Fahrenheit (130° F.). The thin wall of the hollow structural box 720 can be any of a variety of thicknesses varying from one millimeter (0.039 inches) to 10 millimeters (0.390 inches) or greater but averages roughly 7 millimeters (0.273 inches). However, hollow structural box 720 may also be assembled in a cold or room temperature state. In other words, under 130 degrees Fahrenheit. As with any shelled part, the hollow structural box 720 generally defines an interior portion 1102 and an exterior portion 1104. The interior portion 1102 and exterior portion 1104 are separated by the top 702, the bottom 704, the front side 706, the back side 708, the left side 710 and the right side 712.

Also shown in FIG. 11 the hollow structural box 720 may be provided with a plurality of bottom openings 1112 formed in the bottom 704. FIG. 11 shows six bottom openings 1112, however less than six bottom openings 1112 may be provided, as well as more than six may be provided. In other words the number of bottom openings 1112 can vary and the number of top is not limited to the embodiment shown in FIG. 11. The plurality of bottom openings 1112 are generally aligned with a plurality openings in the strut channel frame (FIG. 18) for receiving the connectors 526 as described later. The plurality of top openings 1204 (FIG. 12) and the plurality of bottom openings 1112 are cut into the hollow structural box 720 after the formation of the hollow structural box 720 to form passages. One exemplary process for cutting is the use of a router with a template attached to the bottom 704.

Figure 12:
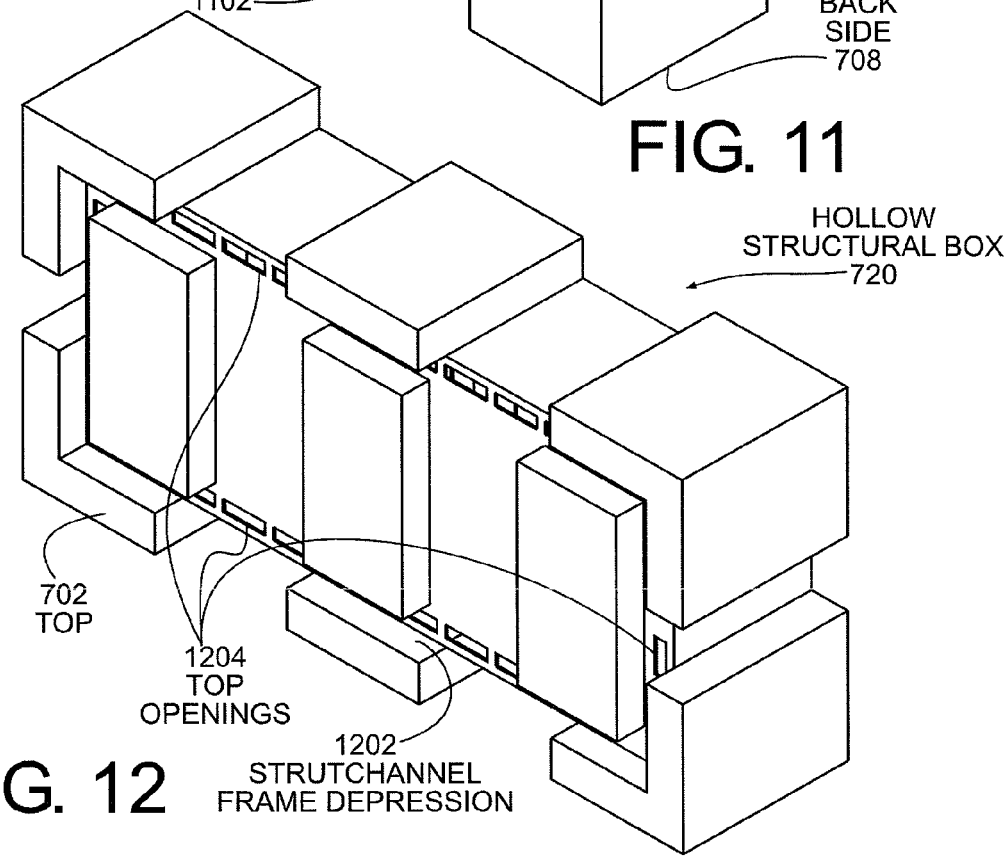
FIG. 12 is a perspective view illustrating the top surface of the hollow structural box of FIG. 8.

FIG. 12 is a perspective view of the top 702 of the hollow structural box 720 illustrated in FIG. 8. As illustrated in FIG. 12, the hollow structural box 720 may include a strut channel frame depression 1202 formed in the top 702 for receiving the strut channel frame 718 as illustrated in FIGS. 7, 9 and 10. The hollow structural box 720 may also include a plurality of top openings 1204 formed in the strut channel frame depression 1202. FIG. 12 illustrates six top openings 812, however more than six top openings 812, and less than six top openings 812 may be provided. The plurality of top openings 1204 are aligned with the plurality of bottom openings 1112 (FIG. 11). The plurality of top openings 1204 can be cut in the same manner described above.

Figure 13:
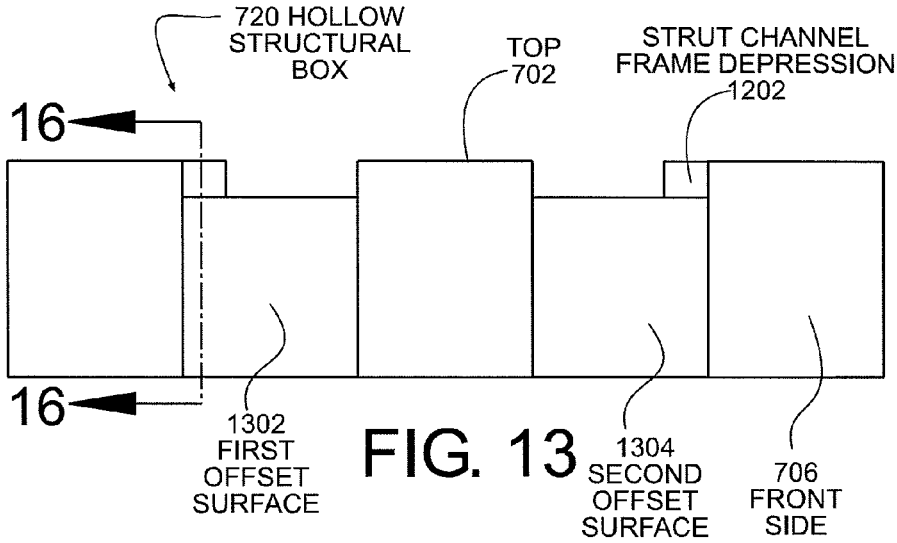
FIG. 13 is a front side elevation view illustrating the hollow structural box of FIG. 8.

FIG. 13 is a side elevation view of the front side 706 of the hollow structural box 720 illustrated in FIG. 8. As illustrated in FIG. 13, the first offset surface 1302 and the second offset surface 1304 are formed in the front side 706 of the hollow structural box 720. The hollow structural box 720 also has the strut channel frame depression 1202 formed in the hollow structural box top 702. Also illustrated in FIG. 13 is a viewing plane 16-16 defining a cross-sectional view of the hollow structural box 720, which is illustrated in FIG. 16.

Figure 14:
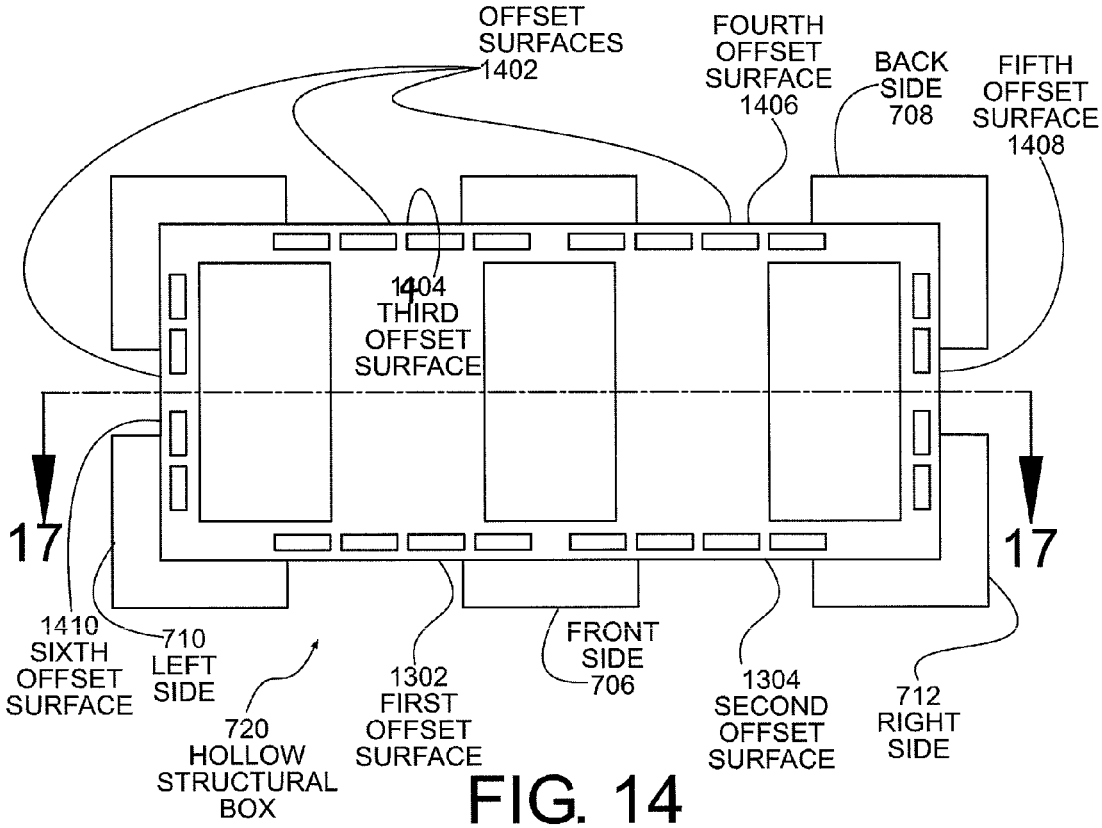
FIG. 14 is a top plan view illustrating the hollow structural box of FIG. 8.
Figure 15:
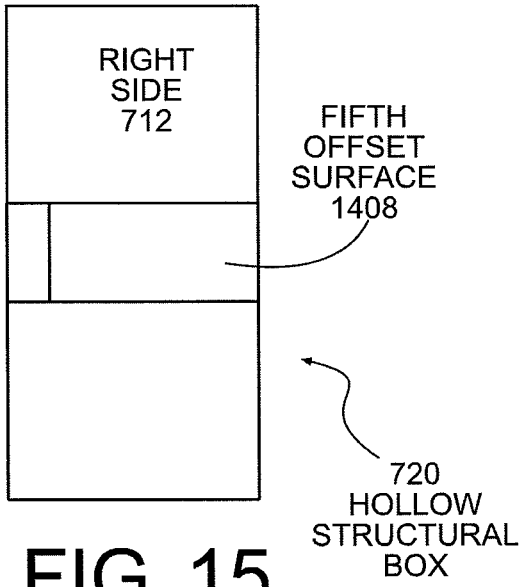
FIG. 15 is a right side elevation view illustrating the hollow structural box of FIG. 8.

FIG. 14 is a top plan view of the hollow structural box 720 illustrated in FIG. 8. As illustrated in FIG. 14, the hollow structural box 720 may be provided with a plurality of offset surfaces 1402 such as, for example, the first offset surface 1302, the second offset surface 1304, a third offset surface 1404, a fourth offset surface 1406, a fifth offset surface 1408, and a sixth offset surface 1410. As previously stated, the first offset surface 1302 and second offset surface 1304 are formed parallel to and offset from the front side 706. The third offset surface 1404 and fourth offset surface 1406 are formed parallel to and offset from the back side 708. With reference to FIG. 15 showing the right side 712 of the hollow structural box 720, the fifth offset surface 1408 is formed parallel to and offset from the right side 712. The sixth offset surface 1410 is formed parallel to and offset from the left side 710. The plurality of offset surfaces 1402 form wall sections between the base structure from which they are offset. The offset surfaces and their walls disrupt the planar geometry and increase the loading capacity of the hollow structural box 720 by increasing the inertial moment of the wall section. For example, the first offset surface 1302 formed in the front side 706 has wall sections that link the two features 1302, 706 that restrict buckling of the hollow structural box 720 under the force of water.

FIG. 15 is a right side view of the hollow structural box 720. FIG. 15 illustrates the fifth offset surface 1408.

Figure 16:
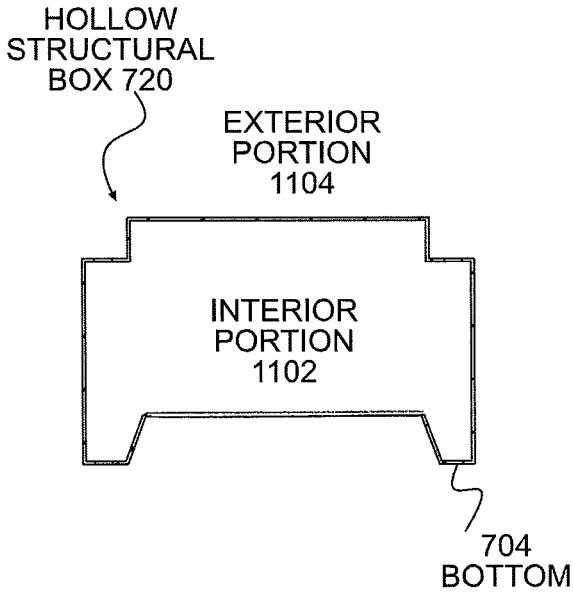
FIG. 16 is a cross-sectional view illustrating the hollow structural box taken across plane 16-16 in FIG. 13 with visible edges suppressed.

FIG. 16 is a cross-sectional view of the hollow structural box 720 illustrated in FIG. 13 and taken across plane 16-16 in FIG. 13. As shown in FIG. 16, the interior portion 1102 of the hollow structural box 1720 is empty. The thin walled structure of the hollow structural box 720 defines the interior portion 1102 versus the exterior portion 1104. The sectional view of FIG. 16 illustrates the bottom portion 704 of the hollow structural box 720.

Figure 17:
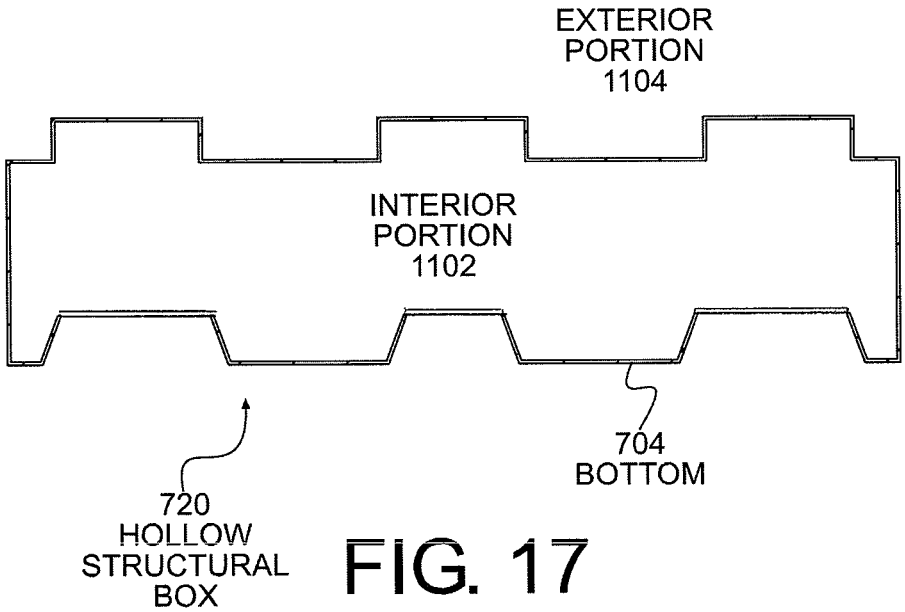
FIG. 17 is a cross-sectional view illustrating the hollow structural box taken across plane 17-17 in FIG. 14 with visible edges suppressed.

FIG. 17 is a cross-sectional view of the hollow structural box 720 illustrated in FIGS. 12 and 14 taken across plane 17-17 in FIG. 14. FIGS. 16 and 17 are illustrated with suppressed visible edges for clarity. In FIGS. 16 and 17, the relatively thin wall of the hollow structural box 720 is clearly illustrated. FIGS. 16 and 17 are useful in conveying the geometry of the hollow structural box 720 defining the interior portion 1102 and the exterior portion 1104.

FIG. 18 is a top plan view of the strut channel frame 718 illustrated in FIG. 8. As shown in FIG. 18, the strut channel frame 718 may include a front strut channel 1802, a back strut channel 1804, a right strut channel 1806, and a left strut channel 1808. In one exemplary embodiment, the strut channels 1802, 1804, 1806, and 1808 of the strut channel frame 718 are made of stainless steel or galvanized steel that has been roll-formed and processed by methods well known in industry.

Figure 20:
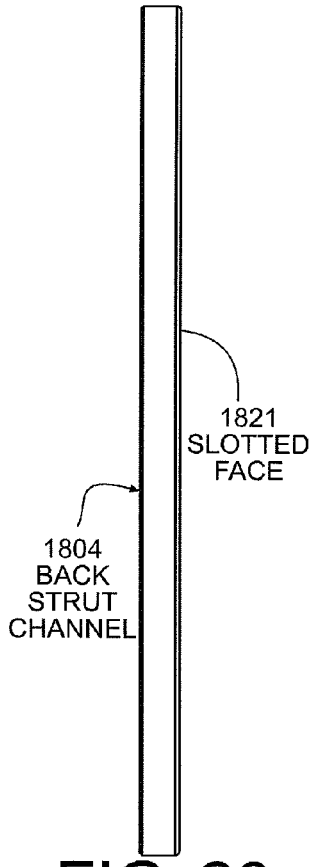
FIG. 20 is a front side elevation view illustrating the strut channel frame of FIG. 18.
Figure 21:
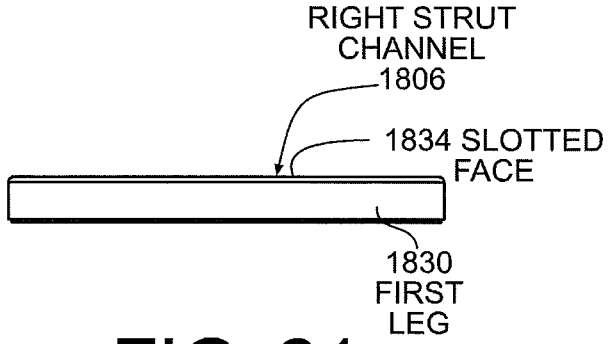
FIG. 21 is a right side elevation view illustrating the strut channel frame of FIG. 18.

With reference again to FIG. 18, the front strut channel 1900 forms an elongated channel that terminates with a first mitered end 1810 and an oppositely disposed second mitered end 1812. The mitered ends 1810, 1812 are formed at a 45 degree angle as illustrated. The front strut channel 1802 has two openings 1812 formed in the web 1814. However, front strut channel 1802 may have more than two openings 1812 or less than two openings 1812. The back strut channel 1804 includes a web 1816, a first leg 1818, a second leg 1820, and a slotted face 2002 (FIG. 20). The first leg 1818 and the second leg 1820 are integrally formed with the web 1816 at a right angle. The slotted face 2002 is integrally formed on the legs 1818, 1820. The back strut channel 1804 forms an elongated channel that terminates with a first mitered end 1822 and an oppositely disposed second mitered end 1824. The mitered ends 1822, 1824 are formed at a 45 degree angle as illustrated. The back strut channel 1804 has two openings 1826 formed in the web 1816, however back strut channel may have more than two openings 1826 or less than two openings 1826. The right strut channel 1806 includes a web 1828, a first leg 1830, a second leg 1832, and a slotted face 1834 (FIG. 21). The first leg 1830 and the second leg 1832 are integrally formed with the web 1828 at a right angle. The slotted face 1834 can be integrally formed on the legs 1830, 1832. The right strut channel 1806 forms an elongated channel that terminates with a first mitered end 1836 and an oppositely disposed second mitered end 1838. The mitered ends 1836, 1838 are formed at a 45 degree angle as illustrated. The right strut channel 1806 has an opening 1840 formed in the web 1828. However, right strut channel may have multiple openings 1840. The left strut channel 1808 includes a web 1842, a first leg 1844, a second leg 1846, and a slotted face 1848 (FIG. 21). The first leg 1844 and the second leg 1846 are integrally formed with the web 1842 at a right angle. The slotted face 1848 is integrally formed on the legs 1844, 1846. The left strut channel 1808 forms an elongated channel that terminates with a first mitered end 1850 and an oppositely disposed second mitered end 1852. The mitered ends 1850, 1852 are formed at a 45 degree angle as illustrated. The left strut channel 1808 has an opening 1854 formed in the web 1842. However left strut channel 1808 may have more than one opening 1854.

FIG. 19 is a cross-sectional view of the front strut channel 1900 taken across plane 19-19 in FIG. 18. As shown in FIG. 19, the front strut channel 1900 includes a web 1814, a first leg 1902, a second leg 1904, and a slotted face 1906. The first leg 1902 and the second leg 1904 are integrally formed with the web 1814 at a right angle. The slotted face 1906 is integrally formed on the legs 1902, 1904, as illustrated in FIG. 19. As also shown in FIG. 19, the hooks 1908, 1910 at the ends of slotted legs 1904, 1902, respectively, form the slotted face 1906. Hooks 1908, 1910 engage a mount 2312 that is attached to rod body 2306, which is further disclosed in FIG. 23. Rod body 2306 and mount 2312 comprise a connector that couples to a strut channel, such as front strut channel 1900. Hooks 1908, 1910 provide the interface with mount 2312 to secure the connector to the strut channel.

FIG. 20 is a side view of the strut channel frame 1718 illustrated in FIG. 8. As shown in FIG. 20, a slotted face 1821 is disposed on the opposite side of the back strut channel 1804.

FIG. 21 is a side view of the right strut channel 1806 illustrated in FIG. 18. As illustrated in FIG. 21, the first leg 1830 has a slotted face 1834.

Figure 22:
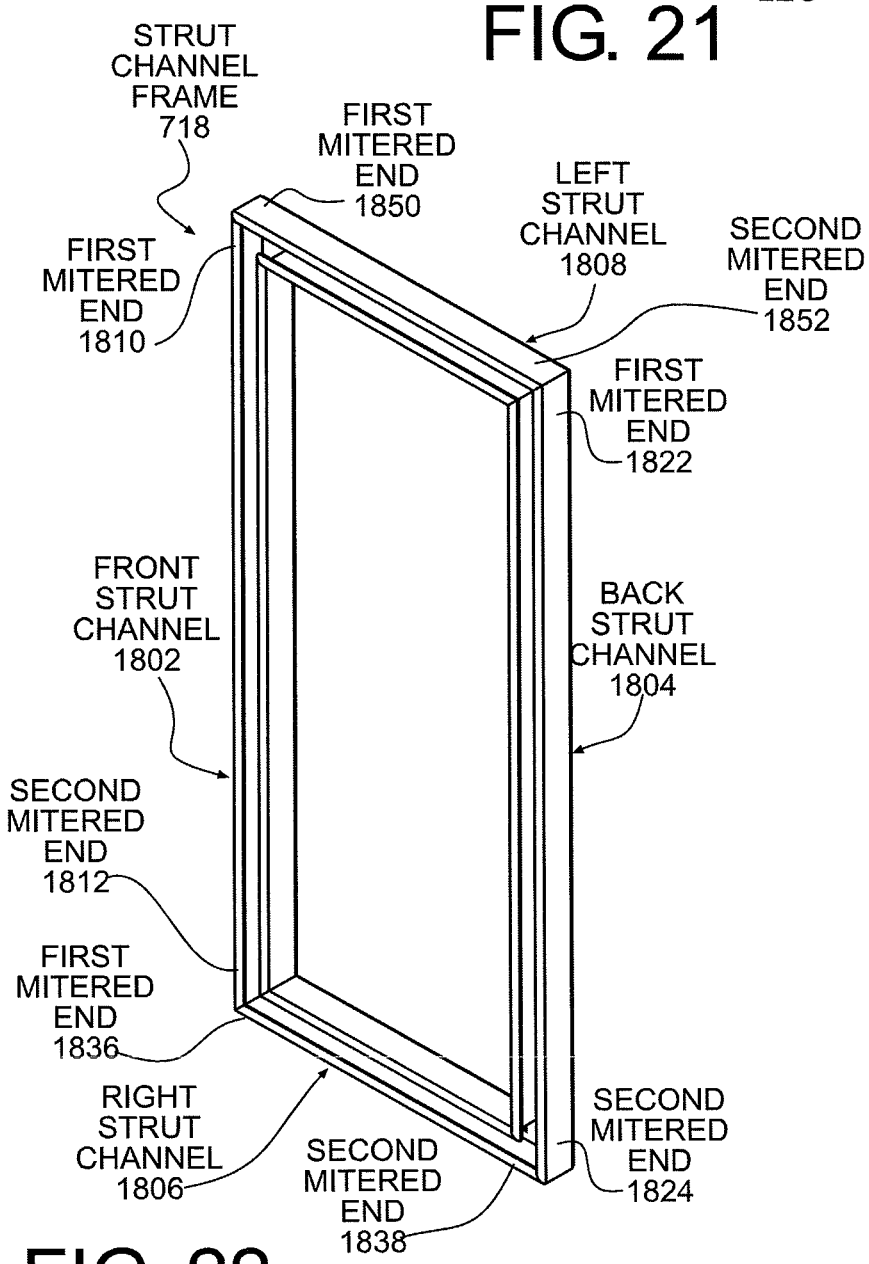
FIG. 22 is a perspective view of the top illustrating the strut channel frame of FIG. 18.

FIG. 22 is a perspective view of the strut channel frame 718 illustrated in FIG. 18. As shown in FIG. 22, the strut channel frame 718 may be configured with the front strut channel 1802, the back strut channel 1804, the right strut channel 1806, and the left strut channel 1808 attached to each other by any of a variety of attachment methods, e.g. welded. If welded, the first mitered end 1810 of the front strut channel 1802 is attached first mitered end 1850 of the left strut channel 1808 by a weld. In a similar manner, the second mitered end 1852 of the left strut channel 1808 is attached to the first mitered end 1822 of the back strut channel 1804. The second mitered end 1824 of the back strut channel 1804 is attached to the second mitered end 1838 of the right strut channel 1806. And, the first mitered end 1836 of the right strut channel 1806 is attached to the second mitered end 1812 of the front strut channel 1802.

Figure 23:
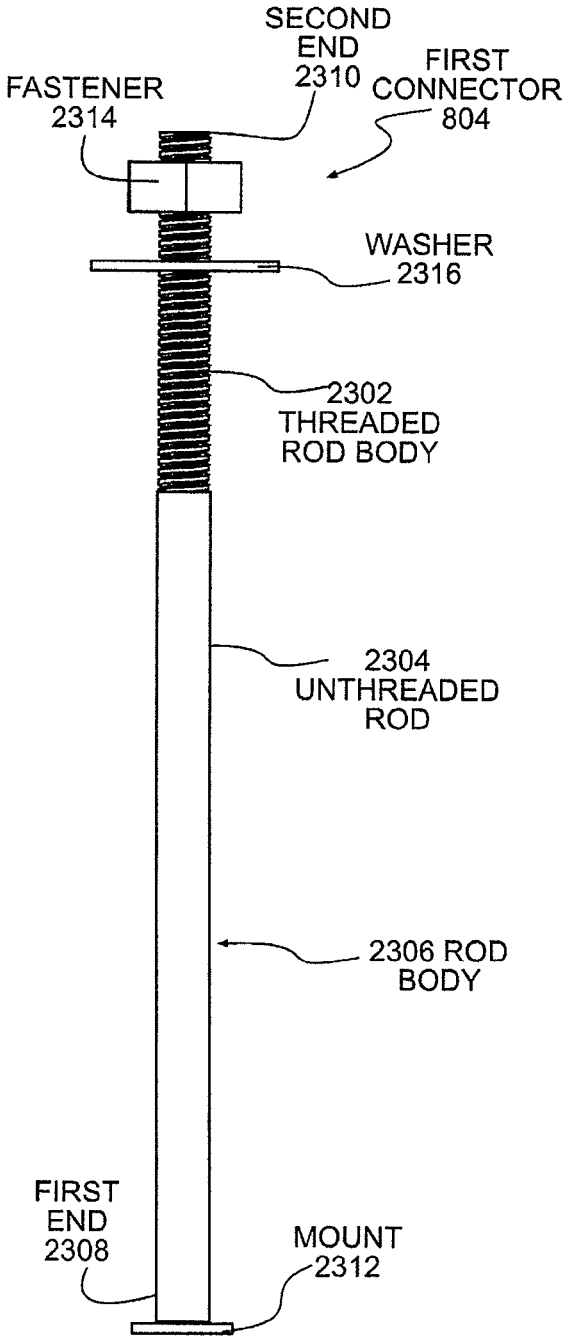
FIG. 23 is a side elevation view illustrating one of the connectors of FIG. 8.

FIG. 23 is a side elevation view of one of the plurality of connectors 526 illustrated in FIG. 8. As shown in FIG. 23, in one exemplary embodiment, the connectors 526 are similar or the same. Therefore, description of a first connector 804 will be provided and it is to be understood that description and reference numerals used for the first connector 804 can be used to describe a second connector 806 (FIG. 8), a third connector 808 (FIG. 8), and a fourth connector 810 (FIG. 8). The first connector 804 is provided with threaded rod body 2302, a first end 2308, and a second end 2310. Rod body 2306 comprises approximately twenty five percent threaded rod body 2302, with the remainder of rod body 2306 unthreaded 2304. However, first connector 804 may be provided as completely or partially threaded. The rod body 2306 terminates at the first end 2308 and the second end 2310. The first connector 804 may be further provided with a mount 2312 fixedly attached to the first end 2308. The mount 2312 is configured to interface with any of the channels 1802, 1804, 1806, 1808 of the strut channel frame 718 or the strut channel rails 124 (FIG. 3). The first connector 804 is further provided with a washer 2316 and a fastener 2314. The washer 2316 is slid over the second end 2310 and then the fastener 2314 is threaded onto the rod body 2306 of the first connector 804 as illustrated in FIG. 23. Washer 2316 is square shaped because fastener 2314 locates into the slot and holds the connector steady. However, washer 2316 may be of other varying shapes, such as a polygon, or circular in shape.

Figure 24:
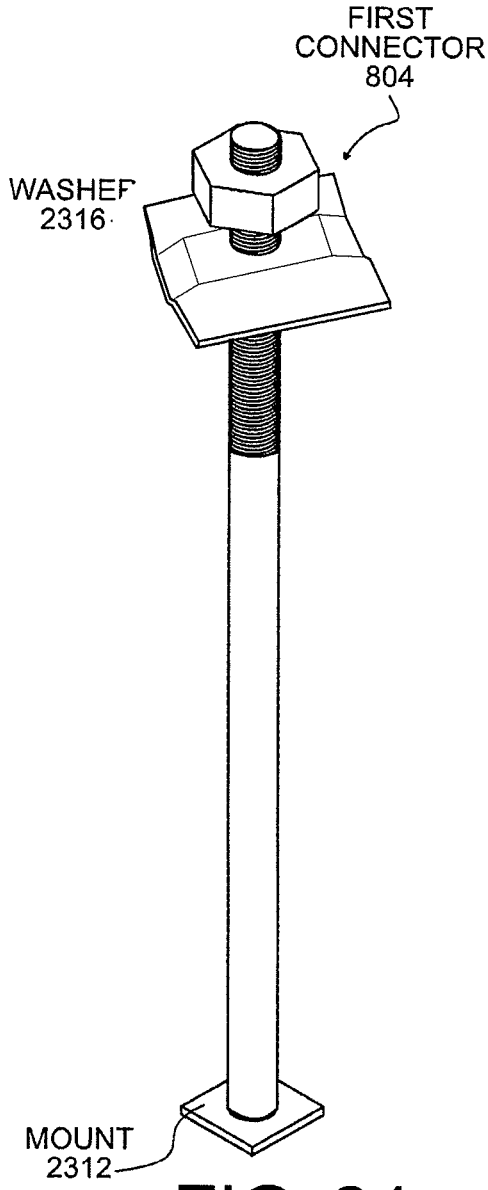
FIG. 24 is a perspective view illustrating the connector of FIG. 23.

FIG. 24 shows a perspective view of the first connector 804 of FIG. 23. Mount 2312 can be constructed to have a rectangular shape to enter the unistrut track and turn to lock in with a serrated groove that bites into the serrated lower edge of the first and second legs 1902, 1904.

With reference again to FIG. 1 and FIG. 4, the preceding exemplary assembly process results in the obstacle wall 128 being constructed on and attached to the river channel 120. After the obstacle wall 128 is configured as illustrated, personnel in the control tower 112 can turn on the flow of water down the river channel 120. To flow water down the river channel 120 the pump station 110 moves water from the lower pond 106 to the upper pond 104. Water flowing down the river channel 120 for the first time moves from the exterior portion 1104 (FIG. 11) of the hollow structural box 720 to the interior portion 1102 (FIG. 11). The water flowing in river channel 120 fills the interior portion 1102 of each obstacle 502 (FIG. 5) as the water level increases to fully submerse the obstacle wall 128. As water flows, it hits the obstacle wall 128 and is redirected to overcome the obstacle under the action of gravity moving the water from the upper pond 104 to the lower pond 106. As previously mentioned, the water imparts a force on the obstacles 502 of the obstacle wall 128. The tension in the connectors plurality of connectors 526 (FIG. 8) and the load-carrying capacity of the hollow structural box 720 (FIG. 8) withstand the force imparted by the water.

As illustrated in FIG. 4, a variety of obstacle assemblies 126 can be configured to move the water in a variety of directions. The particular configuration of the obstacle assemblies 126 changes the degree of difficulty in traveling down the river channel 120, e.g. kayaking from the upper pond 104 to the lower pond 106. If, for a variety of reasons, the personnel operating the water park 100 desire to change the flow of water, the obstacle assemblies 126 can be reconfigured to achieve the desired change.

Figure 25:
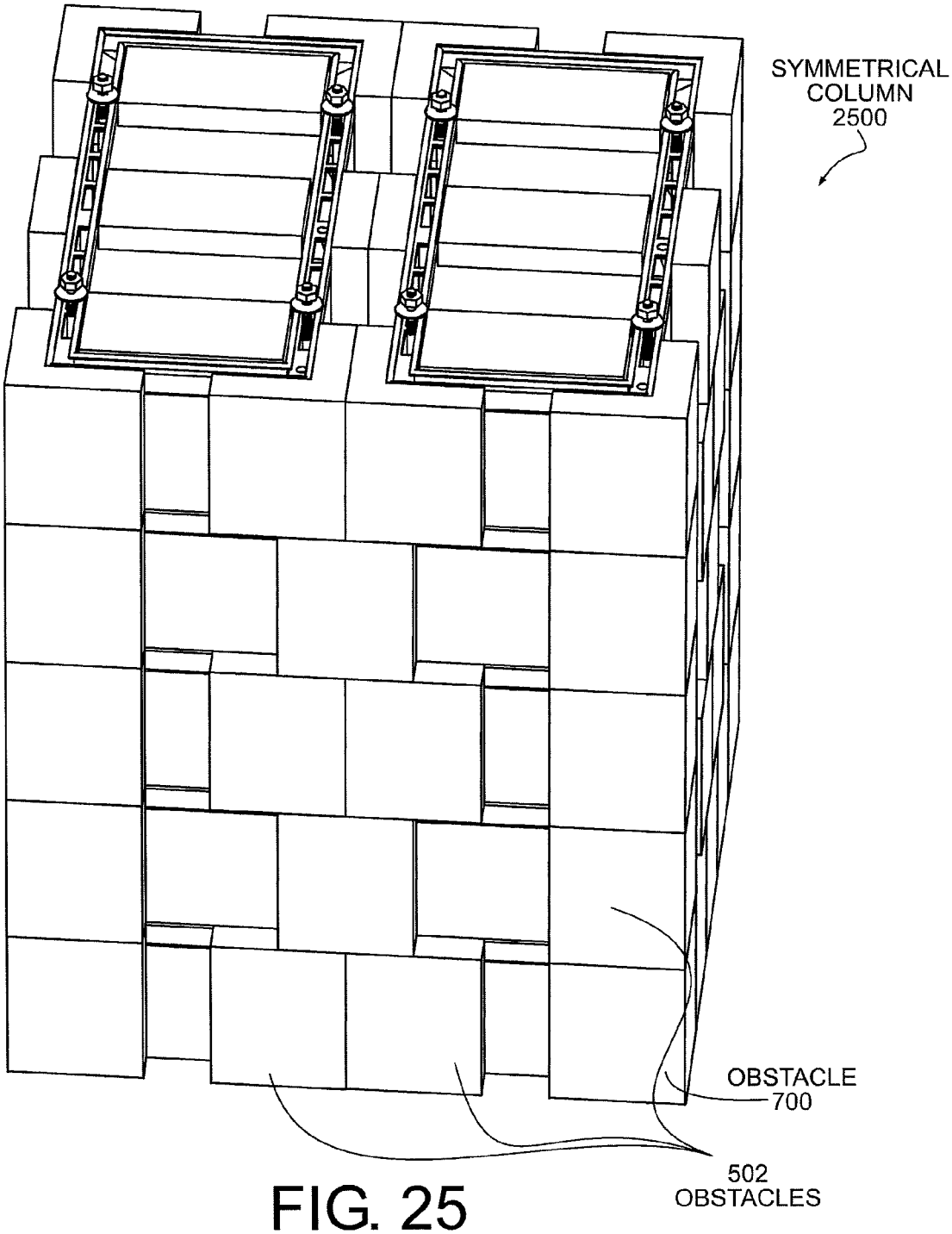
FIG. 25 is a perspective view illustrating an embodiment of an exemplary symmetrical column composed of the obstacles of FIG. 7.

FIG. 25 is an alternative embodiment illustrating an advantage to the modularity of the present obstacle system by enabling construction of a large variety of obstacle assemblies 126. FIG. 25 shows a symmetrical column 2500 composed of the plurality of individual obstacles 502 identical to obstacle 402. In one exemplary embodiment, the length 716 (FIG. 7) of the obstacle 700 is twice the depth 715 (FIG. 7) of the obstacle 402. In other words, the obstacle 700 may have a length of forty inches and a depth of twenty inches making a footprint that is forty by twenty inches. The ratio of length to width makes it possible to alternate pairs of obstacles in layers so that the obstacles create the symmetrical column 2500 illustrated in FIG. 25. In one exemplary application, the symmetrical column 2500 may be utilized to create an island 130 in the lower pond 106.

Figure 26:
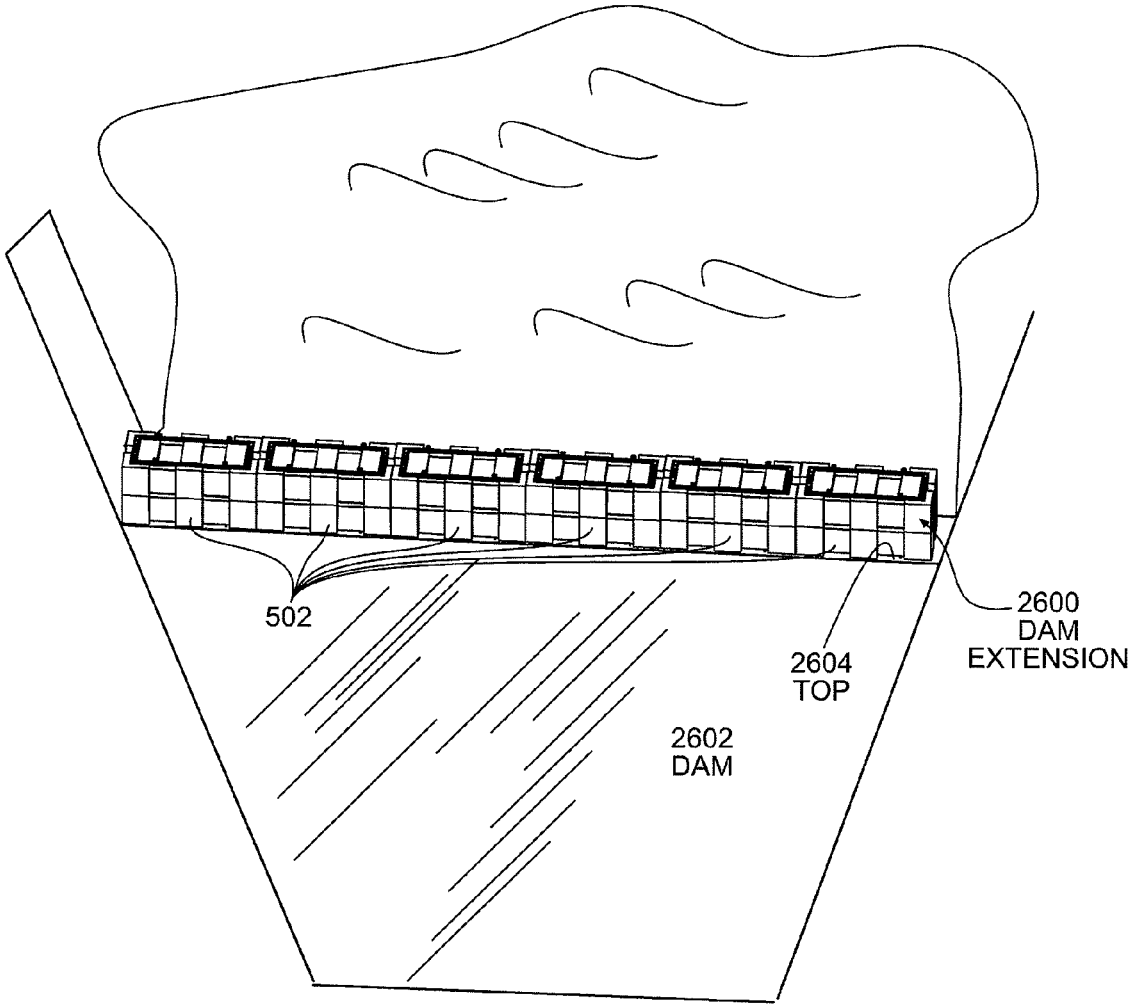
FIG. 26 is a perspective view illustrating an embodiment of a dam extension for increasing the storage capacity of a dam.

Another alternative embodiment is a dam extension 2600 illustrated in FIG. 26. With reference to FIG. 26, in this embodiment, a dam 2602 may require a temporary or semi-permanent extension to a top 2604 of the dam 2602. The obstacles 502 (FIG. 5) can be configured to create the dam extension 2600 having varying depth depending on the particular geometry of the obstacles 502 and the number of layers used to create the dam extension 2600. Additionally, the obstacles 502 may be used to create a low head type dam of a temporary or permanent nature. A temporary dam is often used during in-stream construction to dry an area of the riverbed in preparation for access by earthworks machinery for alteration and/or creation of structures such as bridges, drop structures, or control structures. A temporary dam can be constructed as a semi-circular, or similar structure that surrounds an in-stream work site and that is removed after the in-stream construction is completed. In a more permanent embodiment, the obstacles may be used as flood control or to protect an area of the riverbed from flows.

Figure 27:
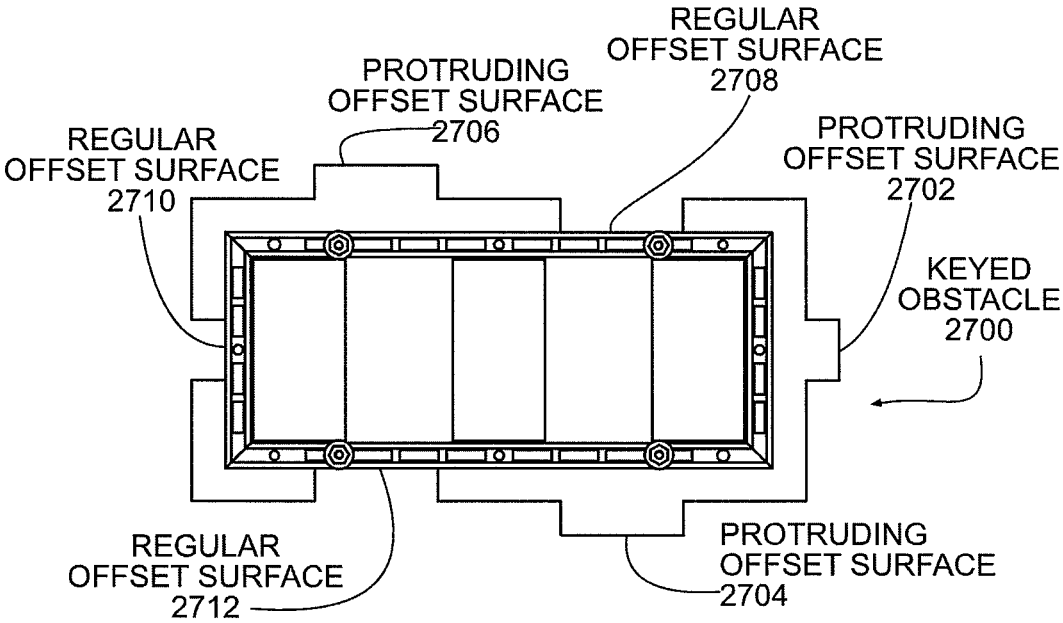
FIG. 27 is a top plan view illustrating an embodiment of a keyed obstacle.
Figure 29:
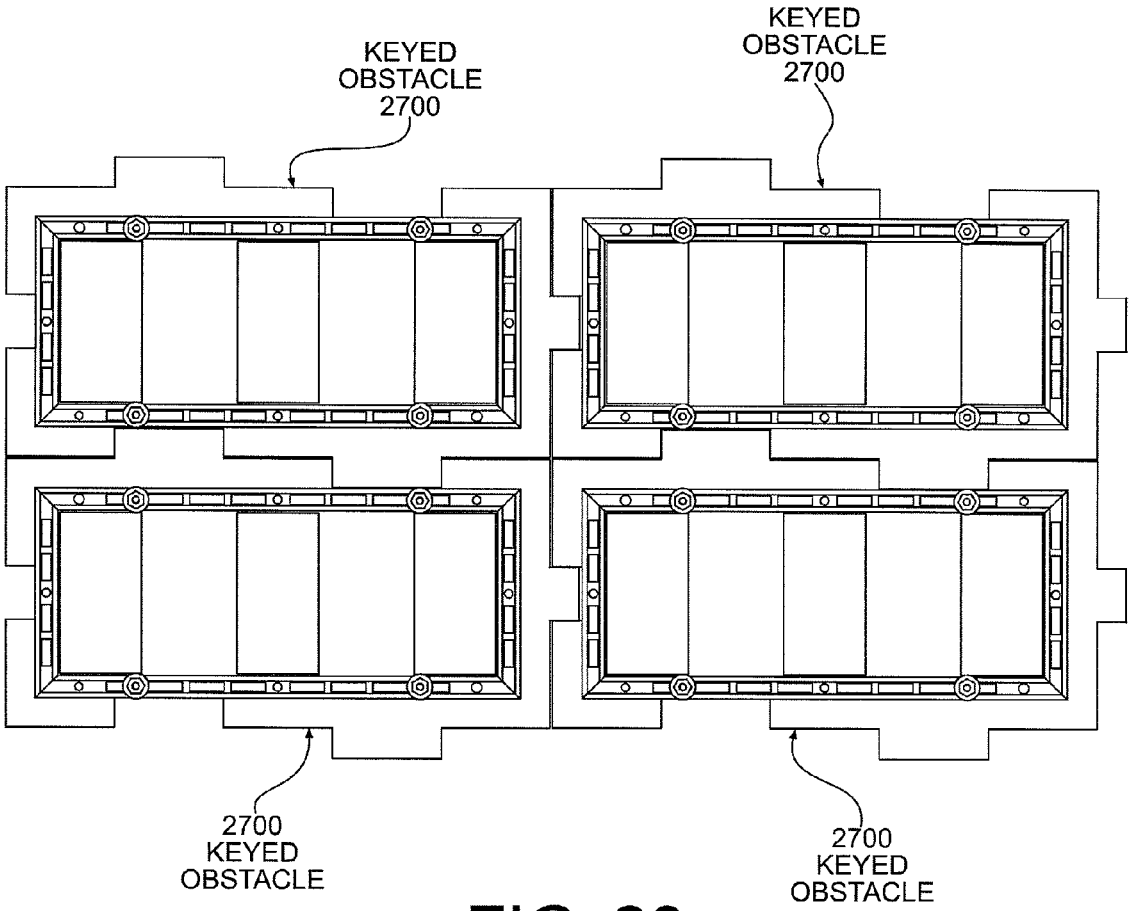
FIG. 29 is a top plan view illustrating a plurality of keyed obstacles of FIG. 27 arranged in a cooperative assembly.

Another alternative embodiment is illustrated in FIG. 27 showing a top plan view of a keyed obstacle 2700. With reference to FIG. 27, the keyed obstacle 2700 is provided with protruding offset surface 2702-2706 that protrude from the keyed obstacle 2700. The protruding offset surfaces 2702-2706 can be inserted into regular offset surfaces 2708-2712 of other obstacles to register adjoining obstacles 2700 as illustrated in FIG. 29.

Figure 28:
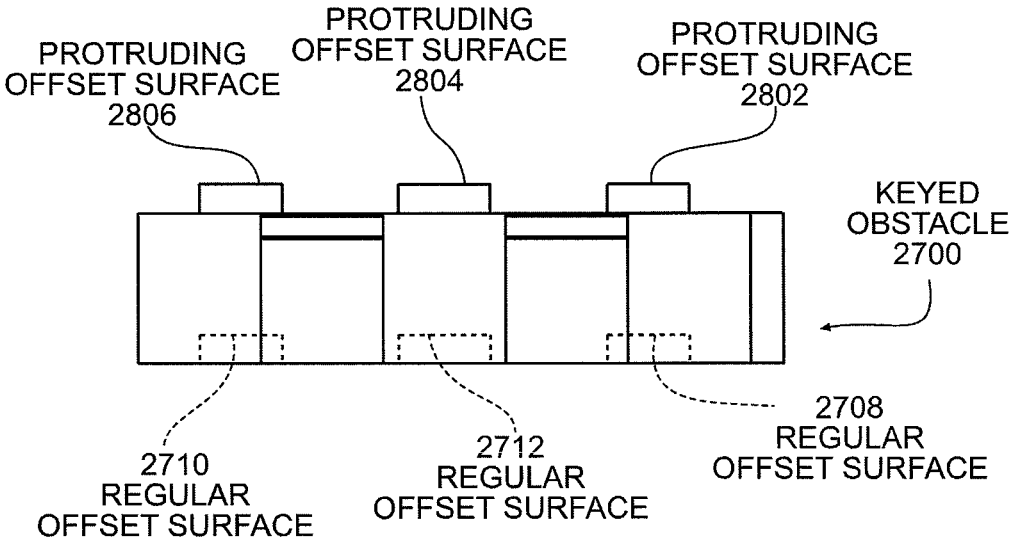
FIG. 28 is a side elevation view illustrating the keyed obstacle of FIG. 27.

FIG. 28 is a side elevation view of the keyed obstacle 2700. Again, the keyed obstacle 2700 has additional protruding offset surfaces 2802-2806 that protrude from the keyed obstacle 2700 that register with regular offset surfaces 2708-2712 of adjoining obstacles. Additionally, keyed obstacle 2700 may have a groyne arrangement.

Figure 30:
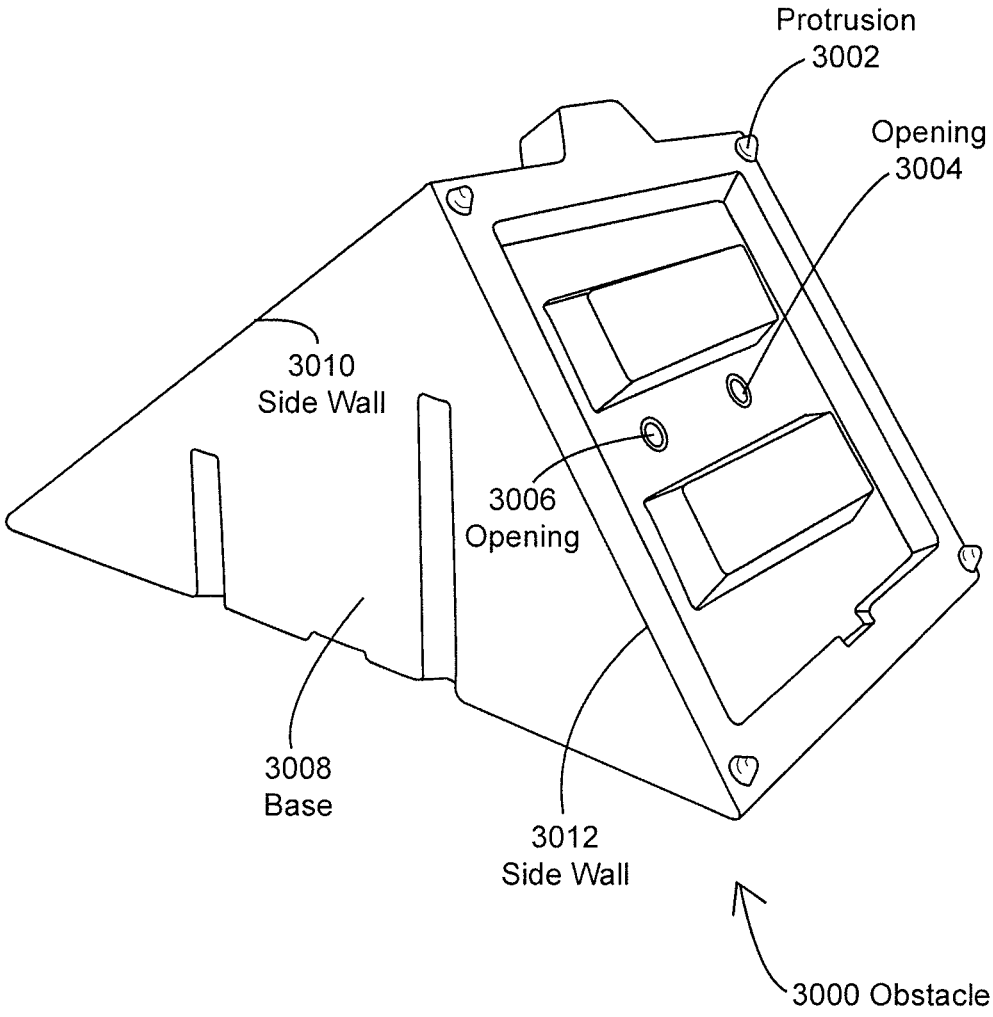
FIG. 30 is a perspective view of an obstacle 3000 that has a triangular shape.

FIG. 30 is a perspective view of an obstacle 3000 that has a triangular shape. Obstacle 3000 has a base 3008 that sits on the base 122 (FIG. 3A) of the river channel 120 (FIG. 1). Side walls 3010, 3012 form a sloped angle to the flow of water down the river channel 120. Protrusions, such as protrusion 3002, mate with lids, such as lids 764, 768, illustrated in FIG. 7F and 7G, to cover the strut channel frames that are disposed in the indentations illustrated in the obstacle 3000. Openings 3004, 3006 allow the obstacle 3000 to be secured to the strut channel rails, such as strut channel rail 302 (FIG. 3A).

Figure 31:
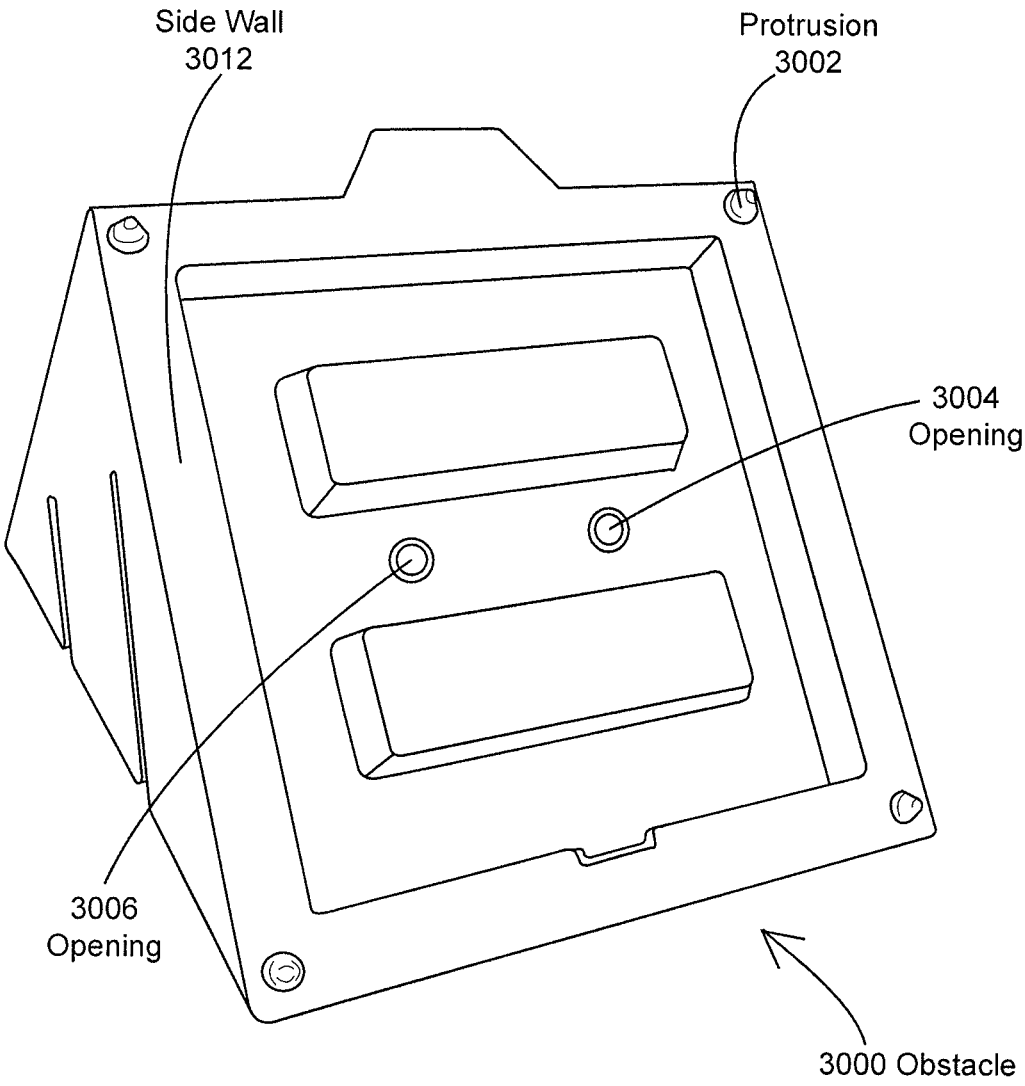
FIG. 31 is an additional perspective view of the obstacle 3000, illustrated in FIG. 30.

FIG. 31 is an additional perspective view of the obstacle 3000, illustrated in FIG. 30. As shown in FIG. 31, openings 3004, 3006 are formed in the sloped surface of side wall 3012. Protrusions, such as protrusion 3002, again, mate with indentations in a lid, such as lids 764, 768 (FIG. 7G) to stabilize and hold the lid to the side wall 3012.

The advantage of having sloped obstacles, such as illustrated in FIGS. 30 and 31, is that some river channels 120 have sloped sidewalls and these sloped obstacles are configured to fit between straight sidewall obstacles and the sloped bank. Additionally, different flow patterns can be generated than the flow patterns that are generated by straight sidewall obstacles. In this manner, the river park 100 (FIG. 1) can be designed to create different flow patterns, as desired. Of course, the angle and steepness of the side walls can be changed as desired.

In another alternative embodiment, the connectors 526 illustrated in FIG. 8 may be substantially longer than illustrated. With reference to FIG. 8, the connectors 526 may be long enough to grip a plurality of layers 504 (FIG. 5). For example, the connectors 526 may grip the fifth layer 514 (FIG. 5), the fourth layer 512 (FIG. 5), the third layer 510 (FIG. 5), the second layer 508, and the first layer 506 (FIG. 5). These longer connectors 526 may be used exclusively in making the obstacle wall 128 (FIG. 5), or, may be used in conjunction with connectors 526 previously described.

In another alternative embodiment best illustrated in FIG. 7, the connectors 526 protrude above the top 702 of the obstacle 700. The protruding connectors 526 engage with the bottom openings 1112 formed in the bottom 704 of the hollow structural box 720. The engaged connectors 526 increase the loading capacity of an assembly of obstacles 700 by transferring loads between obstacle wall layers 504 (FIG. 6).

In another alternative embodiment additional shapes such as lids, angled groynes, platforms, rock-shaped tops, and other geometric shapes may be attached to the top of the system or be used as an integral part of the system.

In another alternative embodiment the obstacles may be configured to create a rescue platform from which rescue divers may launch into the river or channel to perform, or train for, rescue operations.

The foregoing description of the invention has been presented for purposes of illustration and description. It is not intended to be exhaustive or to limit the invention to the precise form disclosed, and other modifications and variation may be possible in light of the above teachings. The embodiment was chosen and descried in order to best explain the principles of the invention and its practical applications to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of configuring an obstacle assembly for water flowing in a river channel made of a material having a base, a left wall and a right wall comprising:

providing a plurality of strut channel rails attached to said river channel;

providing a first obstacle comprising:

a first hollow structural box;

a first strut channel frame comprising a slotted face and an oppositely disposed web separated by a first leg and a second leg, said first strut channel frame web adjoining said first hollow structural box; and at least one first connector extending through said first hollow structural box and said first strut channel frame;

attaching said first obstacle to one or more of said plurality of strut channel rails with said at least one first connector; and compressing said first hollow structural box between said first strut channel frame and said one or more of said plurality of strut channel rails using said at least one first connector;

providing a second obstacle comprising:

a second hollow structural box;

a second strut channel frame comprising a slotted face and an oppositely disposed web separated by a first leg and a second leg, said first strut channel frame web adjoining said second hollow structural box; and at least one second connector extending through said second hollow structural box and said second strut channel frame;

attaching said second obstacle to said first obstacle with said at least one second connector; and compressing said second hollow structural box between said first strut channel frame and said second strut channel frame.

2. The method of claim 1 and further comprising:

providing a first passage formed in said first hollow structural box for allowing water to flow from an exterior portion into an interior portion of said first hollow structural box; and providing a second passage formed in said second hollow structural box for allowing water to flow from an exterior portion into an interior portion of said second hollow structural box.

3. A reconfigurable obstacle for diverting water flowing in a river channel made of a material having a base, a left wall and a right wall comprising:

a hollow structural box comprising:

a top and an oppositely disposed bottom offset from each other by:

a left side, an oppositely disposed right side, a front side and an oppositely disposed back side;

said hollow structural box defining an interior portion and an exterior portion separated by said top, said bottom, said left side, said right side, said front side, and said back side;

a first plurality of openings formed through said hollow structural box top;

a second plurality of openings formed through said hollow structural box bottom, said second plurality of openings aligned to said first plurality of openings;

a strut channel frame comprising a slotted face and an oppositely disposed web separated by a first leg and a second leg, said strut channel frame web adjoining said hollow structural box top;

a third plurality of openings formed in said strut channel frame web, said third plurality of openings aligned to said hollow structural box first plurality of openings;

at least one first connector defining a first end and an oppositely disposed second end, said at least one first connector comprising:

a mount attached to said at least one first connector first end;

a fastener attached to said at least one first connector second end;

said at least one first connector extending through both said hollow structural box bottom and said hollow structural box top thereby piercing through said hollow structural box interior portion;

said at least one first connector oriented so that said first connector mount is both adjacent to said hollow structural box bottom and located in said hollow structural box exterior portion; and, said first connector fastener is both adjacent to said strut channel frame slotted face and located in said hollow structural box exterior portion;

said at least one first connector pierces at least one of said hollow structural box first plurality of openings, at least one of said hollow structural box second plurality of openings, and at least one of said strut channel frame third plurality of openings; and said first connector mount attached to said river channel through at least one strut channel rail thereby diverting water flow in said river channel.

4. The reconfigurable obstacle of claim 3 wherein said hollow structural box is plastic.

5. The reconfigurable obstacle of claim 3 and further comprising:

a passage formed in said hollow structural box bottom for allowing water to flow from said exterior portion into said interior portion.

6. The reconfigurable obstacle of claim 5 and further comprising:

the at least one strut channel rail is attached to said river channel; and said first connector mount is attached to the at least one strut channel rail.

7. The method of claim 6, wherein said plurality of strut channel rails attached to said river channel are embedded in said river channel.

8. The reconfigurable obstacle of claim 5 and further comprising:

an offset surface formed in at least one of said hollow structural box top, said bottom, said left side, said right side, said front side, or said back side.

9. The reconfigurable obstacle of claim 5 and further comprising:

a first offset surface and a second offset surface formed in at least two of said hollow structural box top, said bottom, said left side, said right side, said front side, and said back side.

10. The reconfigurable obstacle of claim 5 and further comprising:

an obstacle width defined by a length of said hollow structural box front and back sides; and an obstacle depth defined by a length of said hollow structural box left and right sides, said obstacle depth is half of said obstacle width so that a plurality of obstacles can be stacked in alternating pairs to create a symmetrical column having a square footprint.

11. A method of configuring an obstacle assembly for water flowing in a river channel made of a material having a base, a left wall and a right wall comprising:

providing a first obstacle comprising:

a first hollow structural box; and at least one first connector extending through said first hollow structural box;

attaching said first obstacle to said river channel through at least one strut channel rail with said at least one first connector; and compressing said first hollow structural box against said river channel with said at least one first connector;

providing a second obstacle comprising:

a second hollow structural box; and at least one second connector extending through said second hollow structural box; and attaching said second obstacle to said first obstacle with said at least one second connector; and compressing said hollow structural box against said first obstacle with said at least one second connector.

12. The method of claim 11 and further comprising:

providing a first strut channel frame comprising a slotted face and an oppositely disposed web separated by a first leg and a second leg, said first strut channel frame web adjoining said first hollow structural box, wherein said attaching said first obstacle to said river channel with said at least one first connector compresses said first hollow structural box between said river channel and said first strut channel frame.

13. The method of claim 11 and further comprising:

wherein the at least one strut channel rail is attached to said river channel, wherein said attaching said first obstacle to said river channel with said at least one first connector comprises attaching said at least one first connector to one or more of the at least one strut channel rail.

14. A method of configuring an obstacle assembly for water flowing in a river channel made of a material having a base, a left wall and a right wall comprising:

providing a first obstacle comprising:

a first structural box; and at least one first connector extending through said first structural box;

attaching said first obstacle to said river channel through at least one strut channel rail with said at least one first connector; and compressing said first structural box against said river channel with said at least one first connector;

providing a second obstacle comprising:

a second structural box; and at least one second connector extending through said second structural box; and attaching said second obstacle to said first obstacle with said at least one second connector; and compressing said structural box against said first obstacle with said at least one second connector.

15. The method of claim 14 and further comprising:

providing a first strut channel frame comprising a slotted face and an oppositely disposed web separated by a first leg and a second leg, said first strut channel frame web adjoining said first structural box, wherein said attaching said first obstacle to said river channel with said at least one first connector compresses said first structural box between said river channel and said first strut channel frame.

16. The method of claim 15 and further comprising:

wherein the at least one strut channel rail is attached to said river channel, wherein said attaching said first obstacle to said river channel with said at least one first connector comprises attaching said first connector to one or more of the at least one strut channel rail.

* * * * *